United States Patent [19]

Mihail

[11] Patent Number: 4,789,016

[45] Date of Patent: Dec. 6, 1988

[54] CONTAINER FILLING APPARATUS

[75] Inventor: Stavros Mihail, Renton, Wash.

[73] Assignee: Promation Incorporated, Seattle, Wash.

[21] Appl. No.: 915,646

[22] Filed: Oct. 9, 1986

Related U.S. Application Data

[63] Continuation-in-part of Ser. No. 791,226, Oct. 25, 1985, abandoned.

[51] Int. Cl.[4] ..... B65B 3/34

[52] U.S. Cl. ..... 141/143; 141/180; 141/83; 198/463.4; 198/464.1; 198/467.1; 222/380; 222/383; 222/372; 417/394; 417/478

[58] Field of Search ..... 222/207, 209, 372, 380, 222/383, 386.5, 387, 389; 141/129, 1, 145, 138, 140–143, 152, 180; 417/394, 395, 478, 479; 198/463.4, 464.1, 464.3, 464.4, 467.1, 480.1, 576; 464/160

[56] References Cited

U.S. PATENT DOCUMENTS

| | | | |
|---|---|---|---|
| 1,667,991 | 5/1928 | Russell | 198/467.1 X |
| 1,828,168 | 10/1931 | Ayars | 198/461 |
| 1,993,367 | 3/1935 | Geyer | 222/372 X |
| 2,630,904 | 3/1953 | Bozek | 198/459 X |
| 3,007,416 | 11/1961 | Childs | 417/394 X |
| 3,048,114 | 8/1962 | Browne | 417/394 |
| 3,073,400 | 1/1963 | Bauder et al. | 141/83 X |
| 3,115,165 | 12/1963 | Cunningham, Sr. et al. | 141/83 |
| 3,194,170 | 7/1965 | Ulbing | 417/394 |
| 3,304,881 | 2/1967 | Grisé | 417/394 |
| 3,312,171 | 4/1967 | Cary | 417/394 |
| 3,335,580 | 8/1967 | Simpson, Jr. | 464/160 |
| 3,335,666 | 8/1967 | Czarnecki | 417/394 X |
| 3,500,976 | 3/1970 | Halley | 192/29 |
| 3,556,234 | 1/1971 | Moreno | 141/83 X |
| 3,557,847 | 1/1971 | Hebel | 141/54 |
| 3,587,250 | 6/1971 | Raskhodoff | 464/160 |
| 3,592,319 | 7/1971 | Rousseau | 198/463.4 X |
| 3,805,903 | 4/1974 | Muskat et al. | 177/50 |
| 4,230,195 | 10/1980 | Graffin | 177/1 |
| 4,313,507 | 2/1982 | Hays | 177/1 |
| 4,320,855 | 3/1982 | Ricciardi et al. | 222/56 |
| 4,407,379 | 10/1983 | Pryor et al. | 177/52 |
| 4,452,572 | 6/1984 | Evrard | 417/395 |
| 4,467,844 | 8/1984 | Di Gianfilippo et al. | 141/83 X |

FOREIGN PATENT DOCUMENTS 660700 11/1951 United Kingdom .

*Primary Examiner*—Kevin P. Shaver
*Attorney, Agent, or Firm*—Christensen, O'Connor, Johnson & Kindness

[57] ABSTRACT

An apparatus including dispensers connected to a hopper enable discrete portions of filler material to be introduced into individual containers as they pass through a food canning operation. The dispensers are connected to a hopper and are operable to dispense discrete amounts of filler material that are stored in the hopper. The amount of filler material to be introduced into the containers brings a container weight to within desired tolerances of a selected target weight. The containers are provided to the dispensers by a timing screw that extends adjacent to a conveyor that conveys the containers. The timing screw is synchronized with a transfer gear that directs each container onto a platform below the dispensers.

12 Claims, 10 Drawing Sheets

26
610
303
294
638
668
670
53
658
304
305
52
315
313
317

CONTAINER FILLING APPARATUS

This application is a continuation-in-part of U.S. application, Ser. No. 791,226, filed Oct. 25, 1985, now abandoned.

FIELD OF THE INVENTION

This invention relates to apparatus for automated filling of a series of containers with food product or similar filler material as part of a food processing operation.

BACKGROUND INFORMATION

Generally, container filling operations in automated food processing plants include devices for diverting a continuous stream of containers from a conveyor to an adjacent weighing/filling assembly, which includes mechanisms for weighing each container and adding an approriate amount of filler material to bring the weight of the container to within desired tolerances of a target weight. In most cases, the target weight will be the weight shown on the label of the container. The weighing/filling assembly may be used for filling either completely empty containers or containers that have been partially filled in a prior step in the operation.

The design considerations underlying container filling operations are generally directed to three functions: (1) controlling the movement of each consecutive container as it is diverted from the conveyor to an individual weighing station or platform on the weighing/filling assembly; (2) monitoring the weight of each individual container and calculating the amount of filler material that must be added to the container; and, (3) applying precisely measured portions of filler material to the container to bring the container's weight to within selected tolerances of the target weight. These three functions must be performed at high speeds for optimal productivity, and for extended periods of time with minimum downtime for equipment repair or replacement. Furthermore, for maximum versatility the filling operation should be controllable so that the various operational parameters (target weight, tolerances, etc.) can be readily changed to accommodate various types of filler material and a wide range of container sizes.

The patents issued to Moreno (U.S. Pat. No. 3,556,234) and Pryor et al. (U.S. Pat. No. 4,407,379) disclose filling devices that include a rotating table having a plurality of individual weigh stations or platforms disposed along the perimeter of the table. A series of containers are consecutively transferred from an adjacent linear conveyor onto the weigh stations. Once situated on the weigh stations, the individual containers are filled via overhead spouts or funnels with either liquid (such as oil, as discussed in Moreno) or other free-flowing matter (such as powder, as exemplified in Pryor et al.).

Prior filling devices, directed as they are to dispensing liquid or free-flowing filler material, do not address the special problems that arise when viscid or cohesive matter (such as ground raw fish) is used as filler material. This type of filler material must be forcibly directed into the container in controlled discrete portions. Furthermore, the dispenser used for directing such material must be durable and rapidly responsive to its controls in order to withstand the rigorous service requirements of modern food processing equipment.

Additionally, the container control system, which directs the containers from the conveyor onto the weigh stations, must be capable of receiving the containers from the main conveyor system and swiftly transferring the containers onto and off of the weighing-/filling assembly in rapid succession in order to maximize the productivity of the operation.

SUMMARY OF THE INVENTION

The present invention provides a container filling apparatus directed to high-speed controlled transfer of a succession of conveyed containers from a main conveyor system to an adjacent rotating carousel. The apparatus is equipped with mechanisms for monitoring the container's weight and for dispensing filler material in discrete portions to quickly and accurately bring the weight of any underweight container to within preselected tolerances of the target weight of the container. The apparatus is particularly adapted to dispensing solid viscid filler material but performs equally well with free-flowing material.

In accordance with one aspect of this invention, there is provided a dispenser for directing discrete amounts of filler material from a hopper into the individual containers after the containers are positioned on the carousel. The dispenser is connected to the hopper. The dispenser particularly comprises a housing having an inlet end and an outlet end, the housing also defining a chamber that is enclosed therein. The housing has an inlet passage and an outlet passage. The inlet passage extends through the inlet end of the housing and into the chamber. The inlet passage provides a passage between the hopper and the chamber. The outlet passage extends from the chamber out through the outlet end of the housing.

An elongate, expandable pump member is disposed within the dispenser housing. The pump member extends from within the inlet passage into the chamber to a point near the outlet passage. The expandable pump member is configured and arranged so that expansion of the pump member causes closure of the inlet passage while compressing the contents of the chamber. Expandable valve members are disposed within the outlet passage and are configured and arranged so that expansion of the valve members causes closure of the outlet passage. Also included are actuation mechanisms connected to the dispenser and adapted for expanding and contracting the expandable pump member and the expandable valve members in a particular sequence for drawing the filler material through the inlet passage into the chamber and for expelling controlled amounts of the material therefrom through the outlet passage.

In the preferred embodiment of the invention, the surface of the housing that defines the chamber has a plurality of grooves formed therein that extend in the direction of the elongate expandable pump member. The grooves tend to minimize damage to the expandable pump member when ground fish is used as a filler material. More particularly, since bone fragments in the ground fish tend to puncture the expandable pump member when the member is fully expanded against the inner surface of the chamber, the grooves provide spaces into which the bone fragments can be pushed when the pump member is expanded, thereby reducing the tendency of the bones to damage the pump member.

As another aspect of this invention there is provided a dispenser supply system for storing and supplying filler material to the dispensers. The dispenser supply system includes mechanisms for ensuring that the filler material is continuously directed thorugh the hopper toward each dispenser so that the dispenser operation will not be interrupted. The system particularly comprises a support member to which the hopper is mounted. The dispensers depend downwardly from the hopper bottom. A hopper lid is mounted to the support member to substantially cover the top of the hopper. The dispenser supply system also includes a feeder device connected to the lid which comprises:

(a) a shoe member configured to contact the top of the filler material;

(b) guide mechanisms connected between the lid and the shoe member and configured to permit the shoe member to slide toward and away from the filler material; and (c) mechanisms for urging the shoe member downwardly to apply a predetermined pressure to the filler material.

In the preferred embodiment, the shoe member of the feeder device is immediately retracted from the filler material whenever the lid is opened to refill the hopper. Accordingly, the shoe member will not be buried whenever filler material is added to the hopper.

BRIEF DESCRIPTION OF THE DRAWINGS

The invention with its attendant advantages will become better understood from the following detailed description when considered in combination with the accompanying drawings, wherein.

DETAILED DESCRIPTION OF THE PREFERRED EMBODIMENT

Figure 1:
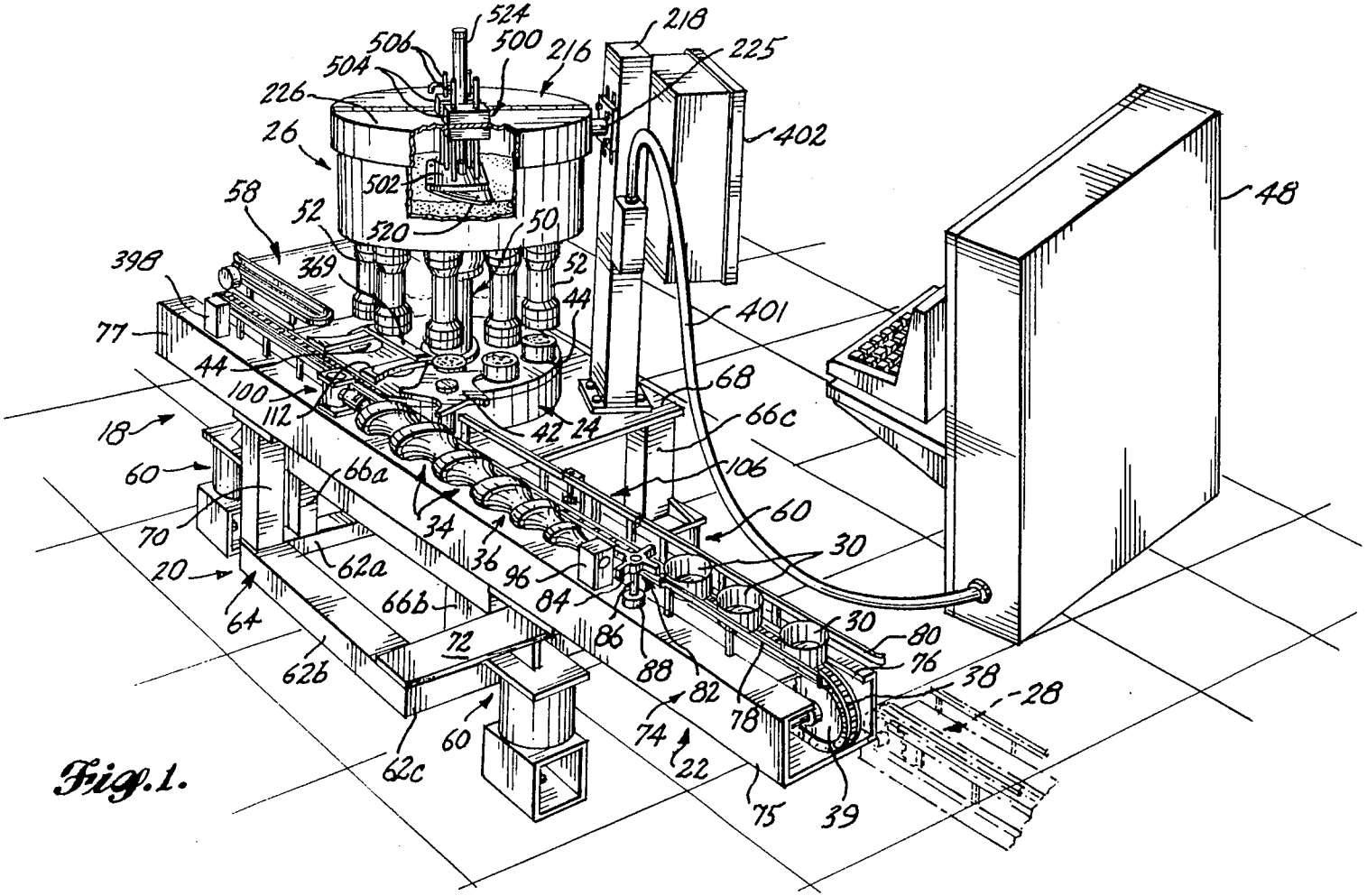
FIG. 1 is an isometric view of the container filling apparatus formed in accordance with this invention.
Figure 2:
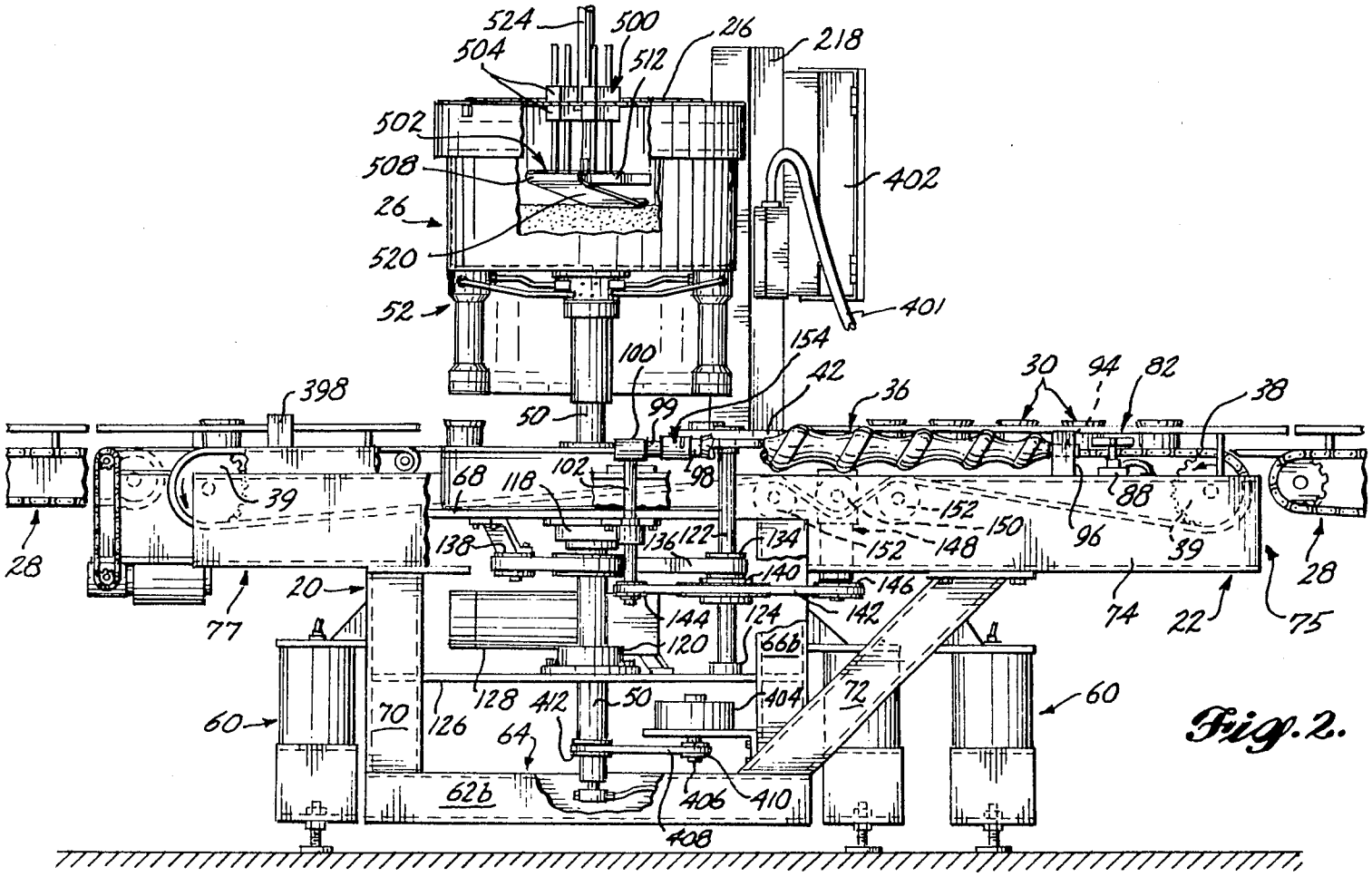
FIG. 2 is a side elevation view of the container filling apparatus of FIG. 1.
Figures 3, 4, 6:
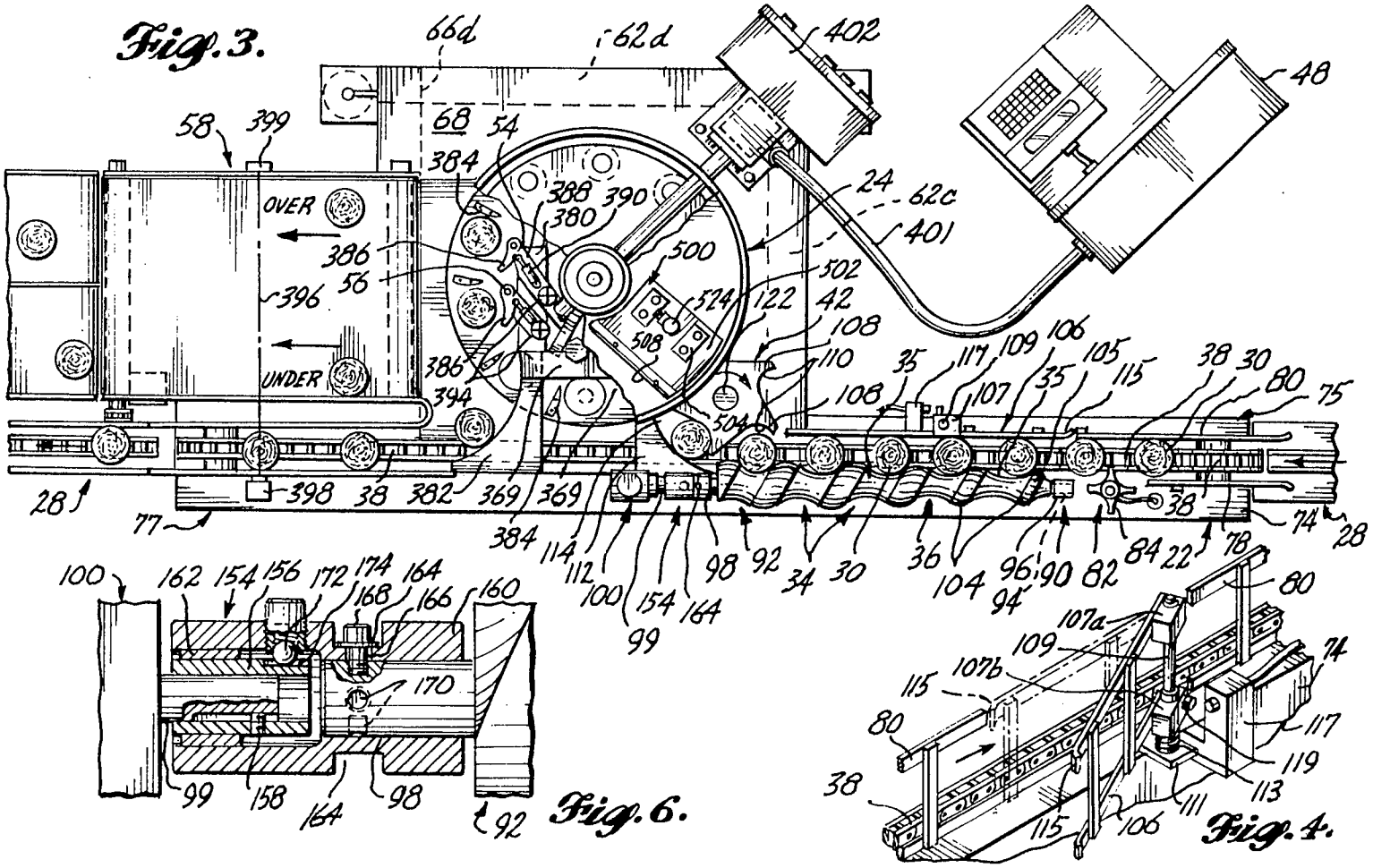
FIG. 3 is a top plan view of the container filling apparatus of FIG. 1.
FIG. 4 is an isometric view of a gate mechanism for halting movement of the conveyor belt when a container becomes jammed.
FIG. 6 is a cross-sectional detail view of an assembly for coupling a drive shaft to the timing screw that facilitates delivery of containers to the carousel.

With reference to FIGS. 1, 2 and 3, the apparatus 18 formed in accordance with this invention generally comprises a base 20 that supports a conveyor unit 22, a rotating carousel 24 and a hopper 26. The apparatus is arranged so that the conveyor unit 22 is incorporated within a conventional conveyor system 28 in a food canning assembly. The apparatus 18 is located in the overall conveyor system at a point where a stream of open containers 30, partially filled with food product such as raw fish segments, is conveyed onto the conveyor unit 22. The individual containers 30 progress along a conveyor belt 38 that extends along the length of the conveyor unit 22. The containers are guided by the flute 34 of a rotating timing screw 36 that is positioned longitudinally adjacent to the conveyor belt 38.

Rotation of the timing screw 36 is synchronized by common drive elements with a star-shaped rotating transfer gear 42 that partially extends across the conveyor belt 38 and sweeps each individual container from the conveyor belt to one of ten platforms 44 mounted on the rotating carousel 24 that is positioned adjacent to the conveyor unit 22. Each platform 44 rests upon a load cell 46 (FIG. 7) that generates an electrical signal representing the weight of the container. Data from the load cell is transmitted to a programmable controller 48.

The hopper 26 is mounted on a main support shaft 50 that projects upwardly from the base 20 through the center of the carousel 24. The hopper 26 is the receptacle in which ground fish is held in order to supply pneumatically-operated dispensers 52 that extend from the hopper 26 over each platform 44. The dispensers 52 are controlled by electrical signals generated by the controller 48.

A feeder device 500 is mounted to the lid assembly 216 that covers the top of the hopper. The feeder device 500 includes a downwardly biased shoe 502 that applies pressure to the top of the ground fish to maintain a constant supply of ground fish to the dispensers.

In operation, each container 30 is diverted from the conveyor belt 38 to a platform 44. The container's weight, as detected by the load cell 46, is transmitted to the controller 48 for comparison with the previously programmed desired container target weight. If the container requires weight correction, the controller 48 signals the appropriate pneumatically-operated dispenser 52 to dispense portions of the filler material (i.e., ground fish) until the desired target weight is reached. If the container 30 is outside of previously programmed tolerances of the target weight by the time it approaches the portion of the apparatus that directs the containers back to the main conveyor unit, one of two rejection levers 54 or 56 (FIG. 3) will be activated to direct the container off the carousel 24 to a separate rejection conveyor 58 before the container can reenter the main conveyor system. The entire apparatus rests upon four piston and cylinder-type pneumatic supports 60 that minimize the amount of vibration transfered to the machine from other nearby machines.

A more detailed description of the preferred embodiment of the invention is offered now with reference first to FIGS. 1, 2 and 3. The apparatus is comprised of a base 20, formed in part by four box beams 62*a*, 62*b*, 62*c*, 62*d* that are fastened to each other at their ends and disposed in a common horizontal plane to form a rectangular lower frame 64 of the base 20.

Four vertical box beam support members 66*a*–d are fixed to, and extend upwardly from the lower frame 64. The vertical support members are arranged with one member near each corner of the lower frame 64. A horizontally-disposed top plate 68 is fastened to the upper ends of the four vertical support members 66*a*–d. Two additional box beam support members 70 and 72 are fixed to adjacent corners of the lower frame portion 64 and extend upwardly therefrom, their upper ends fastened to and supporting the above-mentioned conveyor unit 22.

The conveyor unit 22 is comprised of an elongate conveyor support box beam 74 positioned in longitudinal alignment with the main conveyor system 28. The conveyor support beam 74 has a receiving end 75 where the containers 30 are first received by the apparatus 18 and a discharge end 77 where the filled containers reenter the main conveyor system 28.

A slot 76 is formed in the top of the conveyor support beam 74, extending the entire length thereof. A conventional link-type endless conveyor belt 38 is secured between two toothed wheels 39 that are rotatably mounted on the opposing ends of the beam 74. The toothed wheels 39 are mounted so that the upper length of the conveyor belt protrudes through the slot 76 formed in the top of the conveyor support beam 74. The conveyor belt 38 is driven by drive elements described in detail below.

Two guide rails 78 and 80 are fixed to the top of the conveyor support beam 74 at its receiving end 75. The guide rails are located on either side of the conveyor belt 38 and guide the linear progression of the containers 30 along the conveyor belt. One guide rail 80 extends between the receiving end 75 of the conveyor support beam 74 to a point near the transfer gear 42. The other guide rail 78 extends from the receiving end 75 of the conveyor support beam 74 to a point near an entry control gate 82 that is rotatably mounted on top of conveyor support beam 74.

The entry control gate 82 is comprised of a cross-shaped element 84 mounted on the upper end of a rotatable vertical axle 86. The lower end of the axle 86 resides in a bearing assembly 88 that is fixed to the top of conveyor support beam 74. The projecting arms of the cross-shaped element 84 extend across the path of the conveyed containers 30. The axle 86 of the control gate 82 is normally fully rotatable within bearing assembly 88, hence the cross-shaped element 84 does not impede the progress of the conveyed containers. A solenoid-actuated brake is housed within the bearing assembly 88. When signaled by the controller 48, the brake is activated to prevent rotation of the control gate arms. Accordingly, the container flow along the conveyor 38 (hence to the carousel 24) will be interrupted. The control gate brake can be periodically activated if, for example, one or more of the platforms 44 is inoperable, thereby halting delivery of containers to the carousel 24 until the inoperable platform has rotated past the point where the containers are transferred to the carousel.

The elongate timing screw 36, having an entry end 90 and an exit end 92, is rotatably mounted at those ends in longitudinal alignment with the conveyor belt 38. The entry end of the timing screw 36 is formed into a cylindrical shaft 94 that is rotatably mounted in a bearing 96 that is mounted to the top of the conveyor support beam 74 near the entry control gate 82. The exit end 92 of the timing screw 36 is located adjacent to the transfer gear 42. That end of the timing screw 36 has an integrally formed cylindrical shaft 98 projecting therefrom that is connected to one end of a coupling assembly 154. An extension shaft 99 is connected to the other end of the coupling assembly 154 and projects outwardly therefrom to terminate in a right-angle gearbox 100 mounted on the conveyor support beam 74. A timing screw drive shaft 102, which is connected to the extension shaft 99 at the right-angle gearbox 100, extends from the gearbox downwardly through top plate 68 into base 20 (FIG. 2). The connected timing screw drive shaft 102, extension shaft 99 and timing screw shaft 98 are rotated by drive elements housed within base 20.

Referring to FIG. 3, the helical flute 34 extends from one end of the timing screw 36 to the other. The sidewalls of the flute 34 define a helical rib 104, which also runs the length of the timing screw. When considered in the horizontal axial plane of the timing screw (i.e., as viewed in plan), this configuration results in a plurality of concave guide grooves 35, extending along the length of the timing screw. Clockwise rotation of the timing screw (when viewed from the entry end 90 of the timing screw) effects the longitudinal progression of the guide grooves 35 from the entry end to the exit end 92 of the timing screw. As will become clear upon reading this description, the guide grooves 35 that face the conveyor belt 38 are used to control the spacing and progression of the conveyed containers 30.

The overall diameter of the timing screw 36 tapers from the exit end 92 to the entry end 90 of the timing screw. The rib 104, which has a leading end 105 corresponding to the entry end 90 of the timing screw, is relatively thin at that end, gradually increasing in thickness along the length of the timing screw. The leading end 105 of the rib 104 protrudes slightly into the path of the conveyed containers 30. Thus, each successive container that is conveyed toward the apparatus abuts against the protruding rib 104 and, due to the rotation of the timing screw, is received in a guide groove 35. Each guide groove 35 is sized to accommodate only one container.

If for any reason a container becomes jammed between the rib 104 and the guide rail 80, thereby failing to slide into a guide groove 35, a mechanism is provided for halting the conveyor 38 until the jamming is relieved. Specifically, a gate 106 is incorporated into the guide rail 80. As shown in FIG. 4, one end of the gate 106 is fastened to a pair of blocks 107*a*, 107*b*, which are rotatably mounted to a vertical shaft 109 at opposing ends thereof. The shaft 109 is fixed at its lower end to a bracket 111 that extends outwardly from the conveyor support beam 74. A spring 113 is coiled around the shaft 109 with its opposing ends fixed to the bracket 111 and the block 107*b*, respectively.

The coiled spring 113 is oriented to urge the gate 106 into a closed position (shown in dotted lines in the figure) wherein the gate is parallel to the conveyor belt 38 with its free end 115 abutting the guide rail 80.

If a container becomes jammed betwen the rib 104 of the timing screw and the gate 106, the force of the container against the gate will overcome the spring force and open the gate. The opening of the gate is detected by a magnetic induction-type proximity sensor 117 that is activated by the movement of a metal stud 119 that is fixed to one of the blocks 107*b*. The sensor can be of any conventional type such as manufactured by Micro Switch Division of Honeywell, Freeport, Ill., Model No. 4FRZ-6. The signal generated by the sensor 117 is transmitted to the controller 48 which, in turn, immediately terminates power to the conveyor.

Once the containers 30 are properly positioned in the guide grooves 35 and moving along the conveyor belt 38, their spacing and movement on the conveyor is defined by the thickness of the portion of the rotating helical rib 104 that extends between each of them. In this regard, the width of the rib 104 of the timing screw 36 is sized so that the spacing between the containers will be just wide enough to allow the projections 108 of the transfer gear 42 to project between each consecutive container as it approaches the transfer gear. Furthermore, the rotation of the timing screw is controlled, as hereinafter described, so that each container 30 will arrive at the rotating transfer gear 42 precisely positioned between two of the gear's projections 108.

As shown in FIGS. 2 and 3, the transfer gear 42 is rotatably mounted to a vertical shaft 122. The projections 108 are shaped to have one side portion 110 curved to substantially match the curvature of the containers 30. The rotational speed of the transfer gear 42 is such that after each projection 108 is moved between a pair of containers 30, the side portion 110 of the projection is brought into contact with the container and the rotation of the transfer gear propels the container 30 toward the carousel 24.

To assist the transfer gear 24 in redirecting the containers from the conveyor belt 38 onto the platforms 44 of the carousel 24, a curved guide bar 112 is fixed to the conveyor support beam 74 to extend across the path of the oncoming containers. The bar 112 projects over the periphery of the carousel 24. Under normal operation, each consecutive container 30 that is propelled by the curved side portion 110 of the projections 108 of the transfer gear 42 will be swept along the curved guide bar 112 to land precisely upon one of the circular platforms 44 mounted on the carousel 24.

A flat, smooth bridge piece 114 is attached to the conveyor support beam 74 and shaped to fit within the opening between the conveyor unit 22 and the carousel 24. The bridge piece 114 provides a horizontal surface between the conveyor and the carousel platforms 44 over which the redirected containers 30 can slide.

It is noted that although ten platforms 44 are depicted in the drawings, it is contemplated that any number of platforms might be used depending upon the desired speed of the carousel. For the dispenser and carousel of this invention, ten or twelve platforms are preferred.

The carousel 24 is driven so that the platforms 44 will be precisely positioned to receive a container 30 just as a container 30 is moved by the transfer gear 42 onto the carousel. As noted earlier, the carousel 24, transfer gear 42 and timing screw 36 are all driven by common drive elements - an arrangement that ensured continuous precise positioning and movement of the containers from the conveyor to the platforms 44. This discussion is now directed to those drive elements.

Figure 5:
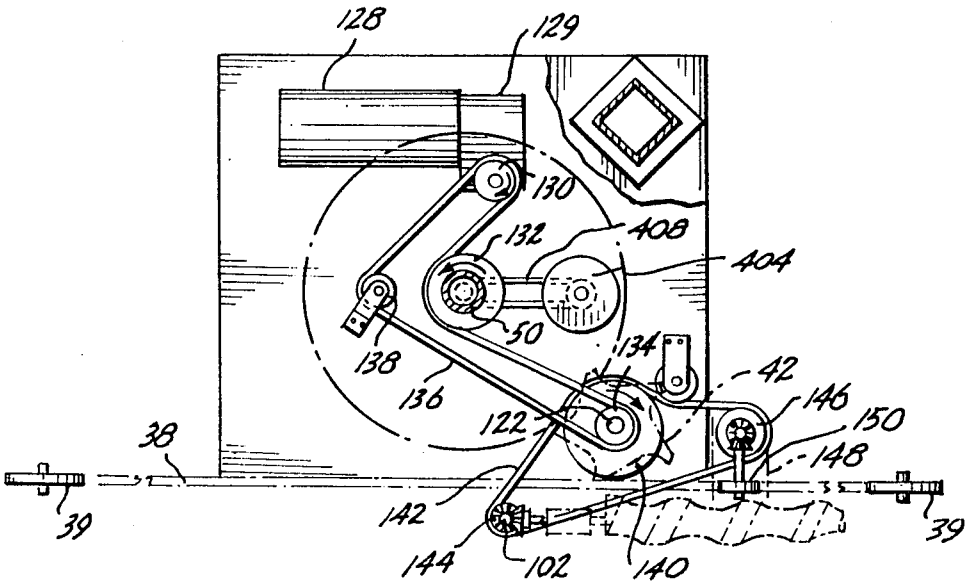
FIG. 5 is a top plan schematized view of the main drive elements of the container-filling apparatus.

As shown in FIGS. 2, 3 and 5, the carousel is fixed at its center to a main support shaft 50 that projects vertically from the base 20 into the central portion of the hopper 26. Specifically, main support shaft 50 is rotatably mounted via first and second bearings 118 and 120, respectively, to the base 20. The first bearing 118 is fastened to the underside of top plate 68. The second bearing 120 is fastened to a flat mounting plate 126, which is a horizontally disposed plate fixed to the support members **66*a*, 66*b*, 66*c* and 66*d* between the top plate 68 and the lower frame portion 64 of the base 20**.

The transfer gear 42 is fixed at its center to the upper end of the rotatable shaft 122 that passes through the top plate 68. The lower end of the shaft 122 is journaled into a bearing 124 that is secured to the mounting plate 126. The transfer gear shaft 122 has a rotational axis parallel to the main shaft 50.

A D.C. motor 128 is mounted to the mounting plate 126. A right-angle gearbox 129 is attached to the output end of the D.C. motor. A first timing belt pulley 130, having a rotational axis parallel to the main shaft 50, extends from the right-angle gearbox and is driven by the D.C. motor 128. A second timing belt pulley 132 is fixed to the main shaft 50 at the same elevation as the first (drive) timing belt pulley 130. A third timing belt pulley 134 is fixed to the transfer gear shaft 122 at the same elevation as the first and second timing belt pulleys.

An endless double-sided timing belt 136 extends between and around the first (drive) timing belt pulley 130 and the third timing belt pulley 134. The exterior side of the timing belt 136 wraps partially around the second timing belt pulley 132 that is fixed to the main shaft 50. An idler pulley 138, mounted to the underside of the top plate 68, is positioned within timing belt 136 and is adjustable to maintain tension in the belt. The D.C. motor drives the first timing belt pulley 130. The timing belt 136 transmits the rotational motion of the first timing belt pulley 130 to the attached second and third timing belt pulleys 132 and 134. The diameters of the second and third timing belt pulleys are dimensioned so that the transfer gear shaft 122 will rotate the transfer gear twice as fast as the main carousel shaft 50. Specifically, since the transfer gear 42 has five projections 108 and the carousel has ten platforms, the former must rotate twice as fast as the latter. Alternately, if twelve platforms were employed, the transfer gear would preferably have four projections 108, hence the transfer gear shaft 122 would be rotated thrice as fast as main shaft 50.

The relative positions of the transfer gear 42 and the carousel 24, once adjusted so that one of the projections 108 of the transfer gear will sweep a container precisely onto a corresponding circular platform 44, will be maintained throughout operation of the apparatus by the fixed timing belt 136 and corresponding drive elements.

The transfer gear shaft 122 is connected to elements for driving the rotation of the timing screw drive 102 and the conveyor belt 38. Specifically, an additional timing belt pulley 140 is fastened to the transfer gear shaft 122 to drive a second endless timing belt 142. That second belt 142 winds around another timing belt pulley 144 that is fixed to the free end of the timing screw drive shaft 102 that projects through the top plate 68. The second timing belt 142 also winds around a pulley 146 that extends from a conveyor drive right-angle gearbox 148. The conveyor drive gearbox 148 is mounted inside the conveyor support beam 74. A drive gear 150, which is connected to pulley 146 at the conveyor drive right-angle gearbox 148, engages the conveyor belt 38. A pair of idler gears 152 mounted to the conveyor support beam 74 on either side of the drive gear 150 also engage the conveyor belt and are adjusted to maintain proper tension therein. In summary, the second timing belt 142 that is driven by the transfer gear shaft 122 is configured to provide corresponding rotation of the timing screw drive shaft 102 (hence the timing screw 36) and to drive (via the conveyor drive gearbox 148) the conveyor belt 38.

It can be appreciated that although the drive elements just described include belts interconnected between the main drive motor 128 and the various driven elements (e.g., shaft 50, transfer gear shaft 122), one of ordinary skill in the art could readily substitute direct drive elements (e.g., bevel gears, etc.) for the belt system and achieve acceptable results.

As noted earlier, the rotation of the timing screw 36 is such that as each conveyed container 30 arrives at the exit end 92 of the timing screw, a projection 108 of the rotating transfer gear 42 will move into contact with the container to sweep the container onto a platform 44 of the carousel. For the arrival of the container to properly coincide with the movement of the projection 108, the rotational position of the timing screw, hence the longitudinal position of the guide grooves 35 that are defined by the flute 34, must be precisely adjusted relative to the position of the transfer gear.

In this regard, reference is made to FIGS. 3 and 6, which illustrate a mechanism through which the rotation position of the timing screw 36 can be adjusted vis-a-vis the position of the projections 108 of the transfer gear. Specifically, the coupling assembly, shown generally as 154 in the figures, is interconnected between the timing screw shaft 98 that extends from the exit end 92 of the timing screw 36 and the extension shaft 99 that extends from the right-angle gearbox 100.

The elements of the coupling assembly include a sleeve 156 that fits over the end of extension shaft 99. The sleeve 156 is held in place by a set screw 158 that passes through the sleeve and bears upon a flattened part of the shaft 99. The sleeve-covered end of the shaft 99 fits within one end of a bore of a tubular coupling 160. An annular bearing 162 is positioned between the sleeve 156 and coupling 160. Timing screw shaft 98 fits within the other end of the bore in the coupling 160.

An annular recess 164 is formed near the end of the coupling 160 in which the shaft 98 is positioned. A slot 166 is formed to extend through the bottom of the recess 164 to the bore of the coupling 160. The slot 166 extends along approximately one-quarter of the circumference of the recess. The shank of a cap screw 168 passes through the slot and is engageable with one of four threaded radially oriented apertures 170 that are formed in the shaft 98 at ninety-degree intervals. Once the timing screw 36 is rotated into the proper position for feeding containers to the transfer gear, the cap screw 168 can be positioned within the slot 166 in alignment with one of the exposed apertures 170. Cap screw 168 is then threaded into the aligned aperture to secure the timing screw shaft 98 to the coupling 160. Rotational motion is transferred between the extension shaft 99 and timing screw shaft 98 by a spring-biased ball detent 172 that is attached to coupling 160 so that the ball is normaly seated in a longitudinal groove 174 formed in the exterior of the sleeve 156. If for any reason the timing screw 36 becomes jammed, the detent 172 will yield to allow rotation of the extension shaft 99, thereby avoiding damage to the timing screw drive shaft 98.

Figure 7:
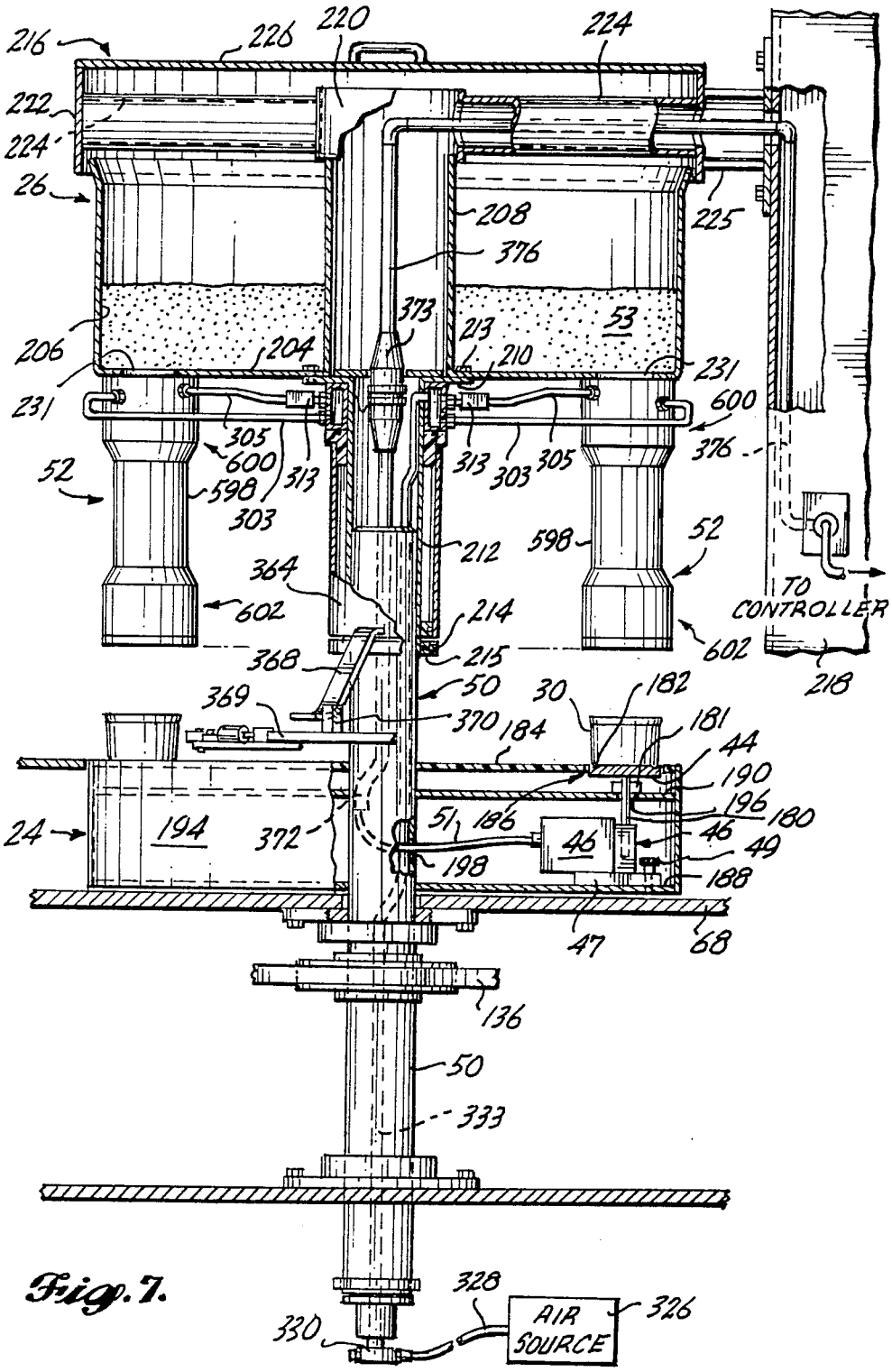
FIG. 7 is a side elevation view, in partial section, of the weighing/filling portion of the apparatus.

Following on the above discussion relating to the delivery of individual containers from the conveyor to a platform on the carousel, this description now turns to the elements of the apparatus that serve to monitor and adjust the weight of the container and the filler material introduced therein. Reference is made to FIG. 7 which, for the sake of clarity, illustrates only a single platform 44, load cell 46 and two dispensers 52.

Carousel 42 consists of three concentric, thin circular disks fixedly mounted at their centers to the main shaft 50. The disks are disposed in parallel planes and include a top disk 184, a bottom disk 188 and a middle disk 190. The disks are surrounded by a circumferential shroud 194 that is wrapped around and fastened to their outer radial edges. The top disk 184 has ten apertures 186 formed at equally spaced-apart locations along its circumference. The circular platforms 44 reside within the apertures 186. The top surface of the platform 44 is coplanar with the top surface of the top disk 184. Preferably, the top disk 184 is formed of low friction material such as the polytetrafluoroethylene polymer manufactured by E.I. duPont de Nemours & Co., under the trademark TEFLON.

A bottom disk 188 forms the bottom of the carousel 24 and supports on its upper surface the load cell 46. The load cell 46 has a bottom plate 47 fastened to its lower surface. Bottom plate 47 is fastened to the bottom disk 188 by knurled shoulder screws 49 that are threaded through plate 47 and into bottom disk 188.

The middle disk 190 is located between the top and bottom disks of the carousel and positioned proximal to the underside of the top disk 184.

Platform 44 has a rod 180 fixed to and depending downwardly from its center. The rod 180 passes through a hole 196 in the middle disk 190, the lower end of the rod 180 being received within the load cell 46. An annular bearing 181 is fastened to the upper surface of the middle disk 190 and surrounds and radially supports the rod 180. The bearing allows the platform to be freely rotatable within its aperture 186.

An annular recess 182 is formed in the upper surface of platform 44. The recess has a diameter corresponding to the diameter of the ridge that projects from the bottom of certain containers, such as cans for fish. The recess 182 acts to stabilize the containers 30 on the platform as the carousel 24 is rotated.

Load cell 46 can be any conventional device that contains a load responsive deflectable manner, the deflection of which causes a change in the electrical resistance of a wire assembly that is attached to the deflectable member. The wire assembly is commonly referred to as a strain gauge. As is well known in the art, the voltage change in a signal conducted by the strain gauge represents the amount of deflection in the deflectable member correlating to the force that causes the deflection. In the preferred embodiment, the deflection is caused by the container weight that is transmitted through the rod 180.

Load cell 46 is connected to controller 48 by wires 51 passing through an opening 198 in the main shaft 50 and into a conduit 372 described in detail below.

When it is necessary to add filler material 53 to the container 30 (as determined by the calculations of the controller 48 in comparing the container weight as measured by the load cell 46 to the preprogrammed desired target weight), the pneumatically-controlled dispenser 52, which depends downwardly from the hopper 26 over the particular underweight container 30, is activated by the controller 48 to dispense discrete amounts of the filler material 53 (ground fish) that is stored in the hopper 26. Before describing the dispenser, attention is directed to the system for supplying filler material to the dispenser. Referring first to FIG. 7, the supply system includes the hopper 26, which is cylindrical in shape and has a bottom 204, a sidewall 206 and a cylindrical core portion 208 fixed to and extending upwardly from the center of the bottom 204. (The above-mentioned feeder device 500 is omitted from FIG. 7 for the sake of clarity.) The upper outwardly flanged end 210 of a cylindrical support sleeve 212 is fastened to the center portion of the bottom 204 of the hopper by conventional threaded fasteners 213. The support sleeve 212 is an elongated, hollow cylindrical element with its lower nonflanged end fitting over the upper end of main shaft 50 to be secured thereto by a plurality of threaded fasteners 214. Those fasteners 214 pass through an annular bearing 215 that fits over the lower end of the support sleeve.

There are ten spaced-apart circular openings 231 formed in the hopper bottom 204 near the outer edge thereof. The filler material 53 passes through the openings 231 to supply the dispensers 52.

The top of the hopper 26 is covered by the lid assembly 216 that is suspended over the upper part of the hopper by a rigid connection to a vertical support column 218. Column 218 is fixed to and extends upwardly from top plate 68. It can be seen that with this arrangement, the lid assembly 216 remains stationary during operation as the hopper (which is mounted to the rotating main shaft 50) rotates relative to the lid. More specifically, the lid assembly 216 comprises inner and outer concentric cylindrical collars 220, 222. The inner collar 220 fits around the upper end of the core portion 208 of the hopper, the outer collar 222 fits around the upper end of the hopper sidewall 206. The inner and outer collars 220 and 222 are joined by two axially aligned tubes 224 that are fastened between them. A hollow cylindrical support bracket 225 is interconnected between the exterior of the outer collar and the support column 218. A hinged lid 226 is attached to the top of the outer collar 222 to cover the hopper. The lid's hinge extends diametrically across the lid in alignment with the tubes 224. One half of the lid is free to swing about the hinge to expose the hopper contents. The other half of the lid is stationary.

As will become clear upon reading this description, vacuum pressure is employed to facilitate the passage of filler material 53 from the hopper 26 into the dispensers 52. If the filler material is highly viscous or otherwise not particularly free flowing, it is possible that voids will form near the openings 231 in the hopper bottom as the dispenser draws filler material from the hopper. Since highly viscous material won't readily flow downwardly to fill the voids, the supply of filler material to the dispensers would be interrupted. Accordingly, the supply system of the present invention includes a feeder device 500 that is mounted to the hopper lid and configured for applying downward pressure to the filler material so that no voids form near the openings 231 as the dispensers draw the material from the hopper. Specifically, with reference to FIGS. 1–3 and 8, the feeder device 500 comprises four mounting blocks 504 fastened to the stationary portion of the lid 226. The blocks 504 are arranged so that two blocks are spaced apart from each other on top of the lid and the two other blocks are similarly positioned under the lid directly beneath the blocks that are on top of the lid. For convenience, a block fastened on top of the lid and an associated block fastened to the bottom of the lid directly beneath it will be referred to as a block set. Two vertically oriented holes are formed thorugh each block set. Holes are also formed in the lid 226 in concentric alignment with the holes in each block set, thereby creating a pair of continuous guide holes 505 extending completely through and between the blocks that comprise each block set. The longitudinal axes of the guide holes 505 are substantially perpendicular to the hopper bottom 204.

The guide holes 505 each receive a guide rod 506 that is slidable therethrough. The lower ends of the guide rods 506 are threaded into a shoe 502. The shoe 502 is a substantially flat member having a leading edge 508, a trailing edge 510, an outer edge 512 and an inner edge 514. The shoe 502 extends across the hopper between the sidewall 206 and the cylindrical core portion 208, substantially parallel to the hopper bottom 204. The outer edge 512 of the shoe is convex in plan and conforms to the curvature of the inside of the hopper sidewall 206. The inner edge 514 of the shoe near its leading edge 508 is concave in plan to conform to the curvature of the hopper's core portion 208.

The leading edge 508 of the shoe 502 is smoothly rounded. The shoe has a think metal plate 520 attached to its leading edge 508. The plate 520 is attached by screws 522 to the top surface of the shoe's leading edge and wraps around that edge and extends away therefrom in a downwardly inclined cantilevered fashion. The free edge of the plate is curved upwardly. It is this plate that directly contacts the filler material 53 in the hopper.

Figure 8:
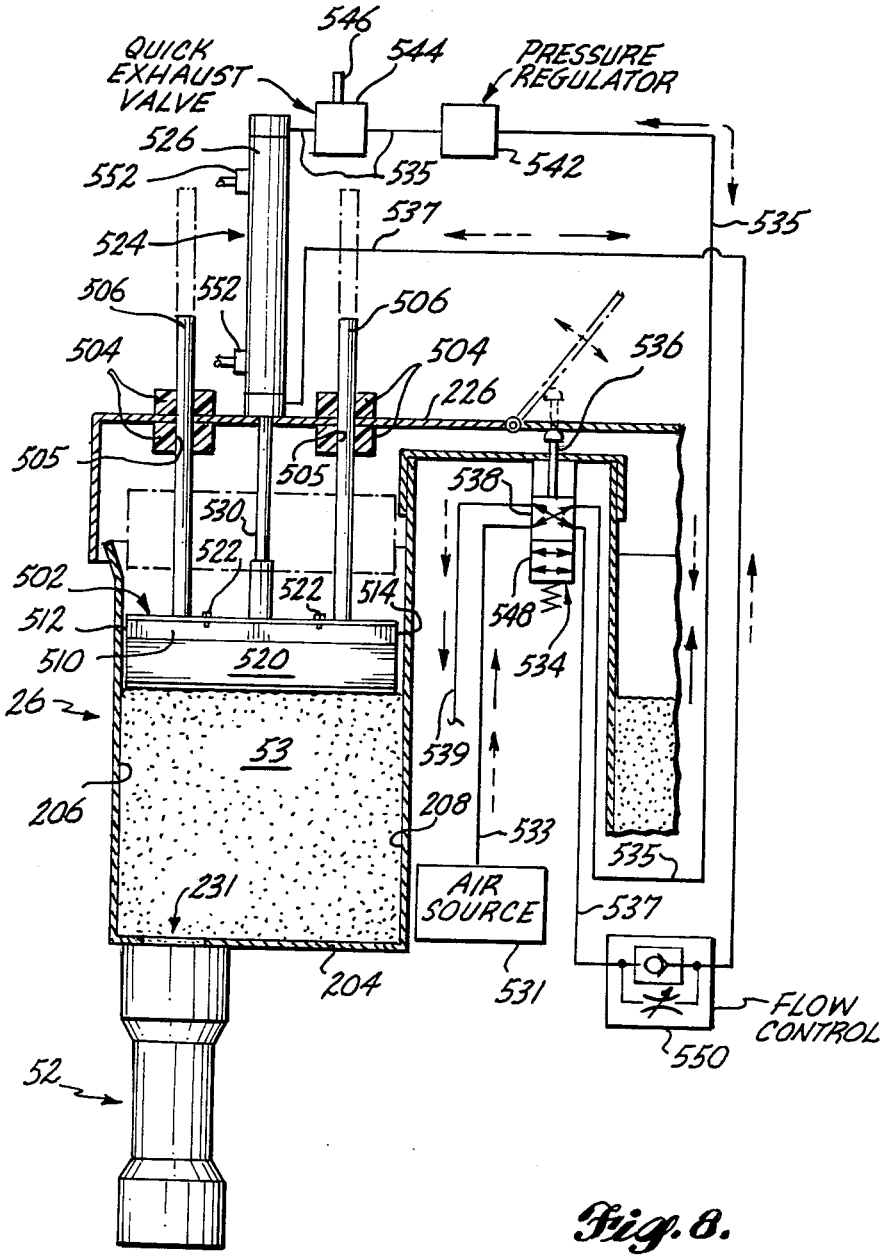
FIG. 8 illustrates, in partial schematic, the dispenser supply system of the apparatus.

A fluid-actuated piston and cylinder assembly 524 is provided to exert a predetermined downward pressure upon the shoe. More particularly, the cylinder portion 526 of the piston and cylinder assembly 524 is mounted to the lid 226 between the two guide block sets. The cylinder extends upwardly substantially perpendicular to the lid. The piston rod 530 of the piston and cylinder assembly extends downwardly through a hole in the lid and is coupled at its end to the top surface of the shoe. The piston and cylinder assembly is a dual action type, actuated by pressurized air conveyed from a regulated source 531 through either of two lines 535, 537 that connect to the cylinder (FIG. 8). That is, when pressurized air is directed into the cylinder through line 535, the piston rod 530 and attached shoe 502 will be forced downwardly. When air is directed into the cylinder through line 537, the piston rod 530 and shoe 502 will be forced upwardly.

Under normal operation, the hopper and its contents rotate relative to the lid 226 and attached feeder device 500. As a result, the plate 520 of the shoe rides over the top of the filler material 53 and provides downward pressure on the material. The downward pressure placed upon the shoe and plate is such that the leading edge 508 of the shoe will remain slightly above the upper surface of the filler material while still forcing the material downwardly toward the openings 231 in the hopper bottom. Preferably, the piston and cylinder assembly 524 is actuated to cause pressure of 3–4 psi to be applied to the filler material when that material is ground fish.

To avoid burying the shoe 502 of the feeder device when the hopper is refilled, it is necessary that the shoe be retracted upwardly from the surface of the filler material 53 when a new supply of filler material is dumped into the hopper. To this end, mechanisms are employed for actuating the piston and cylinder assembly to immediately retract the shoe upwardly when the movable portion of the hinged lid 226 is opened. Specifically, as shown in FIG. 8, a two-position valve 534 having a spring biased plunger 536 is mounted to the hopper 26 so that the plunger is pushed downwardly when the movable portion of the lid is closed (as depicted in solid lines in the figure), thereby maintaining the valve 534 in a first position that is designated 538 in the figure. When in the first position, pressurized air from the air source 531 is directed via line 533 through the two-position valve 534, into line 535 and then through a conventional pressure regulator 542 (set to 3–4 psi), a quick exhaust valve 544, and finally into the upper end of the cylinder 526 of the piston and cylinder assembly 524. The quick exhaust valve 544, preferably Model SQE2, manufactured by Humphrey of Kalamazoo, Mich., is configured so that when air having sufficient pressure is flowing through it, the exhaust port 546 in that valve is closed. The air delivered into the piston and cylinder assembly through line 535 moves the piston rod 530 and the attached shoe 502 downwardly until the plate 520 contacts the filler material 53. Simultaneously, air in the lower end of the cylinder 526 is vented therefrom via line 537, passing through a flow control valve 550, then through valve 534 and out exhaust line 539. The flow control valve 550 has no effect on the flow of the vented air in line 537. The airflow path just described is indicated by the solid arrows in FIG. 8.

When the lid is opened (dashed lines in the figure), the downward force on the plunger 536 of valve 534 is released, thereby permitting the valve to move into a second position designated as 548 in the figure. In that position, pressurized air from source 531 is directed through the valve 534 into line 537, through the conventional flow control valve 550, and into the lower end of cylinder 526 of the piston and cylinder assembly, resulting in the piston rod 530 (hence, shoe 502) being retracted upwardly. Simultaneously, valve 534 vents air from line 535 through the exhaust line 539. This venting results in an immediate pressure drop in line 535. As a consequence, exhaust port 546 in the quick exhaust valve 544 is opened to immediately release the air pressure in the upper end of the cylinder 526 that would otherwise impede the retraction of the piston rod 530. Accordingly, the shoe is retracted very rapidly. The just-described airflow path is indicated by the dashed arrows in the figure.

It is clear that as soon as the hopper is refilled and the lid closed, the system just described will operate to extend the shoe downwardly under the predetermined pressure.

In the preferred embodiment, magnetic induction-type limit switches 552 are fastened at spaced-apart intervals to the cylinder 526. The limit switches such as Model HS-2401, manufactured by Clippard of Cincinnati, Ohio, are connected with the controller 48 and utilized to provide an indication of the level of the filler material 53 in the hopper. That is, as the shoe 502 descends into the hopper while the filler material is being pumped out of it, the piston (not shown) within the cylinder 526 will activate the nearest limit switch. When the lowest limit switch is activated, the controller will halt the apparatus until the hopper is refilled.

Turning now to the particulars of the dispensers formed in accordance with this invention, a typical dispenser 52 is shown in detail in FIGS. 7, 9–12, and in partial schematic in FIGS. 13 through 16. Each dispenser 52 comprises an elongate substantially cylindrical housing 598 having an inlet end 600 that is fastened to the hopper bottom 204 beneath one of the openings 231 formed therein, and an outlet end 602 from which filler material is dispensed into a container.

The housing comprises a body 614 that is fastened between a disk-shaped inlet end piece 604 and a disk-shaped outlet end piece 640. In the preferred embodiment, the body 614 and end pieces 604, 640 are formed of rigid transparent polymerized acrylic resin. Such construction permits easy inspection of the dispenser (e.g., after cleaning); however, it is understood that any suitable material can be used. The inlet end piece 604 is fastened to the body 614 by four threaded fasteners 612. The inlet end piece 604 has a flat upper surface 606 and a flat lower surface 608. The upper surface 606 of the inlet end price is positioned against the bottom of the hopper so that the end piece is concentrically aligned with the opening 231 in the hopper bottom. The diameter of the inlet end piece 604 is greater than the diameter of the opening. Conventional "O" ring seals 605 are seated in both the upper surface 606 and lower surface 608 of the inlet end piece.

Three spaced-apart inlet ports 610 are formed through the inlet end piece 604. In plan view (FIG. 10), the inlet ports 610 are shaped as ellipses bowed inwardly so their longitudinal axes are at a common radial distance from the center of the inlet end piece. The inlet ports 610 are in communication with the interior of the hopper 26 through the opening 231.

The housing body 614 is an elongate, substantially cylindrical element having an upper end 616 and a lower end 618. The upper end 616 of the body 614 has the same diameter as the inlet end piece 604 to which it is fastened. Beginning at a point away from its upper end and extending downwardly therefrom, the periphery of the body has a gradually decreasing diameter portion 620. From the low end of the gradually decreasing diameter portion 620, the body 614 extends with constant external diameter to the center of the body. The lower half of the exterior of the body is shaped as a mirror image of the just-described upper half of the body, including a gradually increasing (i.e., in the downward direction) diameter portion 622 near the lower end 618 of the body.

Two dispenser attachment bolts 624, each having one end press-fit into the hopper bottom 204, depend downwardly therefrom. Each attachment bolt 624 passes through corresponding holes formed in the inlet end piece 604 and the upper end 616 of the body 614. Each attachment bolt terminates within a notch 626 formed in the gradually decreasing diameter portion 620 of the body 614. The notches permit access to the exposed ends of the bolts 624 in order to apply nuts 628 thereto.

The body 614 of the housing has a bore formed in it. The bore is formed with four distinctly-shaped contiguous sections. Specifically, the bore includes a first bore section 634 at the uppermost end of the body with an uppermost diameter dimensioned so that all three inlet ports 610 are in communication with the bore. The first bore section 634 has a constant diameter near its uppermost end and tapers inwardly away from that end. A second bore section 632 extends with constant diameter downwardly from the lower end of the first bore section 634. A third bore section 636 extends downwardly with gradually increasing diameter from the lower end of the second bore section 632 to join a fourth bore section that defines an elongate central chamber 638 that extends through the remainder of the housing body. The first, second and third bore sections are located within the upper end 616 of the body. An inlet passage between the hopper bottom opening 231 and the central chamber 638 is defined by the inlet ports 610 and the first, second and third contiguous bore sections 634, 632, 636.

The surface that defines the central chamber 638 has a plurality of longitudinally oriented grooves 639 formed therein. The grooves 639 are concave in cross section. The portions of the body surface between the grooves are smoothly rounded (see FIG. 12).

At the outlet end 602 of the housing, the outlet end piece 640 is abutted against the lower end 618 of the housing body 614 and is secured thereto by four threaded fasteners 642 that are spaced around the outer edge of the end piece 640. Generally, the outlet end piece 640 is configured to define an outlet passage extending from the central chamber 638 out of the dispenser, and to carry hereinafter-described valve elements that are selectively actuatable for opening and closing the outlet passage. More particularly, the upper surface 644 of the outlet end piece 640 that abuts the lower end 618 of the body 614 has an annular-shaped recess 646 formed therein. At the upper surface 644 of the outlet end piece 640, the diameter of the annular recess 646 is substantially equal to the diameter of the adjacent portion of the central chamber 638. The radially inner wall of the recess is substantially straight (i.e., having a constant diameter) from the top to the bottom 648 of the recess. That wall of the recess defines a boss 682 in the center of the outlet end piece 640. The radially outer wall of the recess 646 extends into the end piece 640 with constant diameter for a short distance, and then slopes inwardly to the bottom 648 of the recess. Extending through the bottom 648 of the recess 646 are a pair of ducts 650 that lead to hereinafter-described valve elements that are carried by the outlet end piece.

Within the central chamber 638 of the housing resides an elongate support rod 668 that extends between both housing end pieces 604, 640. The support rod carries an expandable tube 670 along its length. The rod 668 has a diameter that is roughly one-half the diameter of the central chamber 638. The top portion 672 of the rod has a relatively smaller diameter than the remainder of the rod. The top portion 672 of the rod 668 extends into a cavity 674 that is formed through the center of a boss 676 that protrudes from the center of the lower surface 608 of the inlet end piece 604. The cavity 674 extends completely through the boss 676 and into the central portion of the inlet end piece 604. The top portion 672 of the rod fits snugly within the cavity 674 but does not extend completely into the cavity. The bottom portion 678 of the rod has a diameter relatively smaller than the diameter of the remainder of the rod. That protruding bottom portion 678 is snugly seated within a cavity 680 formed in the center of the boss 682 that is formed in the center of the outlet end piece 640.

The expandable tube 670 that covers the support rod 668 extends nearly the entire length thereof. The expandable tube is held firmly to the rod at its ends by mounting rings 671 that surround the tube and compress the surrounded portion of the tube into V-shaped circumferential grooves 673 that are formed at the location where the rod meets the bosses 676, 682. The diameter of the rod and the attached expandable tube 670 are such that when the tube is in its relaxed state, the inlet passage between the openings 231 in the hopper and the central chamber 638 of the housing body will be open, so that filler material is free to pass from the hopper to the central chamber 638.

Figure 9:
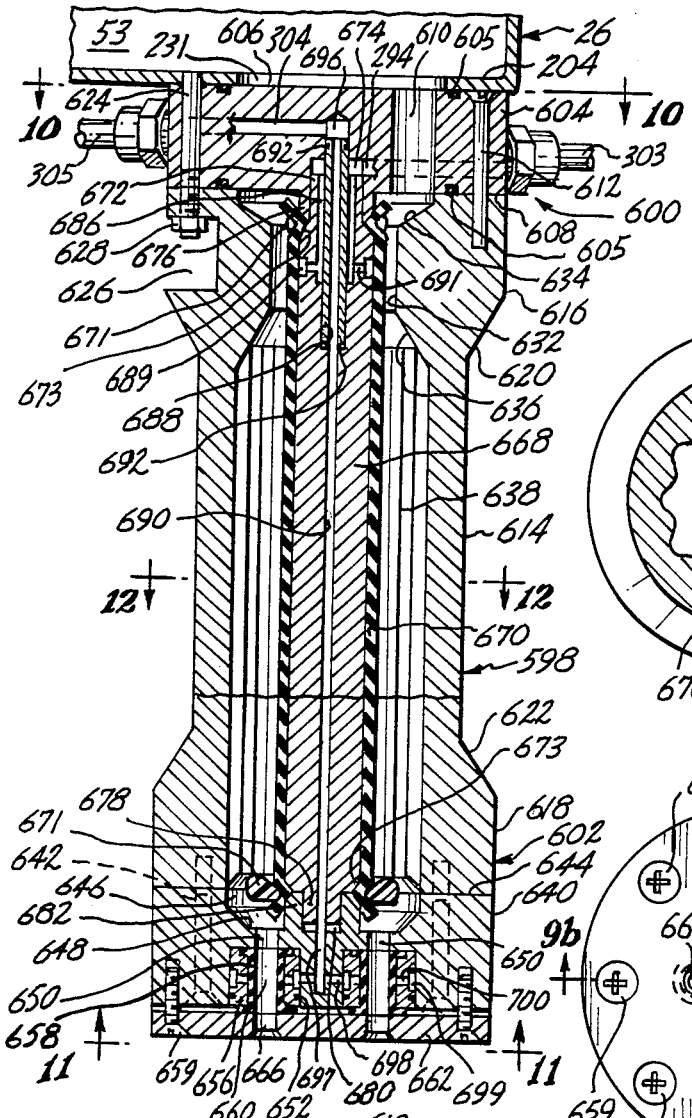
FIG. 9 is a cross-sectional view of a dispenser for dispensing discrete amounts of filler material from the hopper into a container; the top portion of this figure is taken along line *9a—9a* of FIG. 10, and the bottom portion of this figure is taken along line *9b—9b* of FIG. 11.
Figure 12:
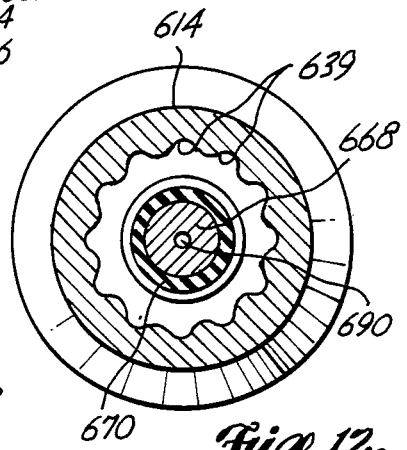
FIG. 12 is a cross-sectional view of the dispenser taken along line 12—12 of FIG. 9.
Figure 11:
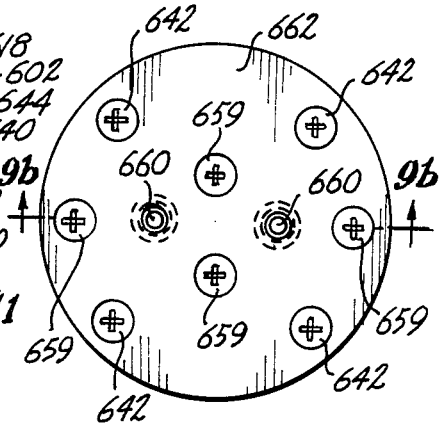
FIG. 11 is a bottom plan view of the dispenser.
Figure 10:
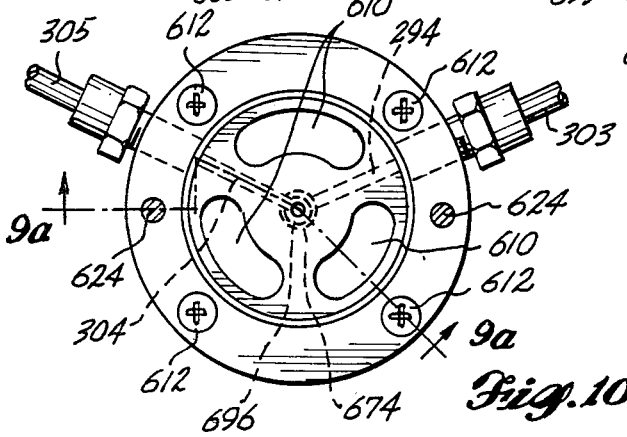
FIG. 10 is a top plan view of the dispenser.

The expandable tube 670 serves as a pumping member and is expanded and contracted (by means described in detail below) to create pumping action that draws filler material from the hopper into the chamber and forces that material through the chamber and out of the dispenser into a container. As noted earlier, the flow of material out of the dispenser is controlled by the valve elements in the outlet end of the dispenser housing. Referring to FIG. 9, each of the above-mentioned ducts 650 extends downwardly and opens at its lower end into a relatively large diameter cylindrical valve cavity 652. The valve cavities extend through the remaining thickness of the outlet end piece 640.

Each of the two valve cavities 652 house a valve spool 656, which secures an expandable, substantially tubular valve member 658 in axial alignment with the duct 650. Specifically, each valve spool 656 has an external diameter approximately equal to the diameter of the cylindrical valve cavity 652. The valve spool 656 has a bore that is slightly larger in diameter than the duct 650. The expandable valve member 658 is preferably a rubber tube which, in its relaxed state, lines the wall of the bore in the valve spool. The central opening 600 of the valve member is concentric with the adjacent duct 650. The ends of the valve members are outwardly flanged to extend partially across the respective upper and lower ends of the valve spool. The valve spools 656 and valve members 658 are held firmly in place by a retainer plate 662 that is secured by threaded fasteners 659 to the bottom of outlet end piece 640. The retainer plate has two outlet ports 666 formed therein. Each outlet port 666 is axially aligned with the opening 660 in an associated valve member 658. The edges of the ports 666 are chamfered at both surfaces of the retainer plate.

The ducts 650, openings 660 and outlet ports 666 define the outlet passage through which the filler material passes from the dispenser chamber 638 into the containers. The valve members 658 are expanded and contracted to precisely control the amount of filler material passing out of the outlet passage. Although two ducts and associated valve members are preferred, it is contemplated that the dispenser will perform satisfactorily if only one or more than two ducts and valve members are employed.

The dispenser is operated by the regulated delivery and venting of pressurized air into and out of the dispenser housing in a manner that causes the expansion and contraction of the expandable tube 670 and valve members 658 in a particular sequence. To effect this operation, the housing 598 and rod 668 have conduits formed therein for conducting the pressurized air to suitable locations for expanding and contracting the tube and valve members.

Specifically, the rod 668 has a stepped axial bore extending completely through it. The bore comprises three contiguous segments: a first segment 686 extending into the top of the rod for a distance of roughly one-sixth of the length of the rod; a second bore segment 688 that is roughly half the length of the first bore segment and has a diameter less than the first segment 686; and a third bore segment 690 having a diameter less than the diameter of the second bore segment 686 and extending from the second bore segment through the bottom of the rod. Two diametrically aligned apertures 691 are formed in the rod to extend radially outwardly from the first bore segment 686. The apertures 691 terminate in an annular recess 689 formed in the outer surface of the rod beneath the expandable tube 670.

The bore of the rod carries a rigid air delivery tube 692 at the top of the rod. The air tube 692 facilitates passage of air to the valve members in the outlet end of the dispenser. One end of the air tube 692 is press-fit into the second bore segment 688 of the rod. The other end of the tube 692 extends outwardly from the rod and carries an O-ring 694 near its outermost end. This end of the tube 694 fits tightly into an upwardly projecting cylindrical extension 696 of the cavity 674 in which the top rod portion 672 is seated. The diameter of the extension 696 of the cavity 674 (hence, the outer diameter of the air delivery tube) is less than the diameter of the cavity 674.

A first pneumatic conduit 294 is formed in the inlet end piece 604 to provide fluid communication between the cavity 674 and a source of pressurized air. Specifically, conduit 294 extends radially through the inlet end piece 604 substantially normal to the longitudinal axis of the dispenser. The inner end of the first pneumatic conduit 294 opens into the cavity 674. The outer end of the first pneumatic conduit 294 is coupled to a first source conduit 303, which in turn is connected to a source of pressurized air that is regulated as described in more detail below.

A second pneumatic conduit 304 is formed to pass radially through the inlet end piece 604 between the extension 696 of the cavity 674 and a second source conduit 305. Second source conduit 305 conducts pressurized air from the source, as described in more detail below.

With the structure just described, when pressurized air is conducted through the first pneumatic conduit 294 into the cavity 674 in the inlet end piece 604, the air will pass into the space between the air delivery tube 692 and the wall of the first bore segment 686 and out through the apertures 691 into the annular recess 689 in the rod. Sufficient air pressure in the recess will cause the expandable tube 670 to expand outwardly, thereby closing the inlet passage at the second bore section 634 in the housing body.

When pressurized air is conducted through the second pneumatic conduit 304 into the extension 696 of the cavity 674 in the inlet end of the rod, it passes through the central opening of the air delivery tube 692 and down through the third bore segment 690 of the rod. At the outlet end of the rod, the pressurized air passes from the third bore segment into a downward extension 697 of the cavity 680 in which the bottom portion 678 of the rod is seated. A pair of apertures 698 extend radially outwardly from this extension. Each aperture opens at its outer end into an associated valve cavity 652. The outer end of the apertures 698 are aligned with annular recesses 699 formed in the outside central surface of the valve spools 656. Radially spaced apertures 700 pass between the annular recess 699 in the valve spools and the bore of the valve spool, which is lined with the expandable valve member 658. In view of the structure just described, it is clear that when pressurized air is conducted through the second pneumatic conduit 304 and air tube 692 into the third bore segment 690, the air will pass through the cavity extension 697, out through the apertures 698, into annular recesses 699 and finally through apertures 700. Sufficient air pressure will cause the expandable valve members 658 to expand inwardly and close their central openings 660, hence, closing the dispenser's outlet passage. Conversely, when the expandable valve members are not actuated by the air pressure (i.e., they remain in their relaxed state), the outlet passage from the chamber remains open so that the filler material is free to pass from the chamber 638 out to the underlying container.

By way of summary, the overall dispenser operation is now described. From the hopper 26 the filler material 53 passes through inlet ports 610, through the first, second and third bore sections 632, 634, 636 in the housing body 614, and into the chamber 638 of the housing 598. The filler material progresses through the chamber 638, through ducts 650, through the openings of the valve members 658 and finally out through the outlet ports 666.

The means for actuating the dispenser to accomplish the movement of the filler material 53 through the above-described path through the dispenser is best described with reference to the schematic drawings in FIGS. 13–16. Specifically, the first source pneumatic conduit 303 is pressurized and vented at controlled intervals. (The particular mechanism for pressurizing and venting the first source conduit is described more fully below). A two-position electronically controlled valve 313 is connected to the second source conduit 305 and is actuatable between a first position shown as 315, which directs the pressurized air in the second source conduit 305 through the second pneumatic conduit 304, and a second position 317, which vents the second pneumatic conduit to the atmosphere. A suitable valve as just described is manufactured by MAC Incorporated of Wixom, MI, Model No. 111B-601B.

Figures 13, 14, 15:
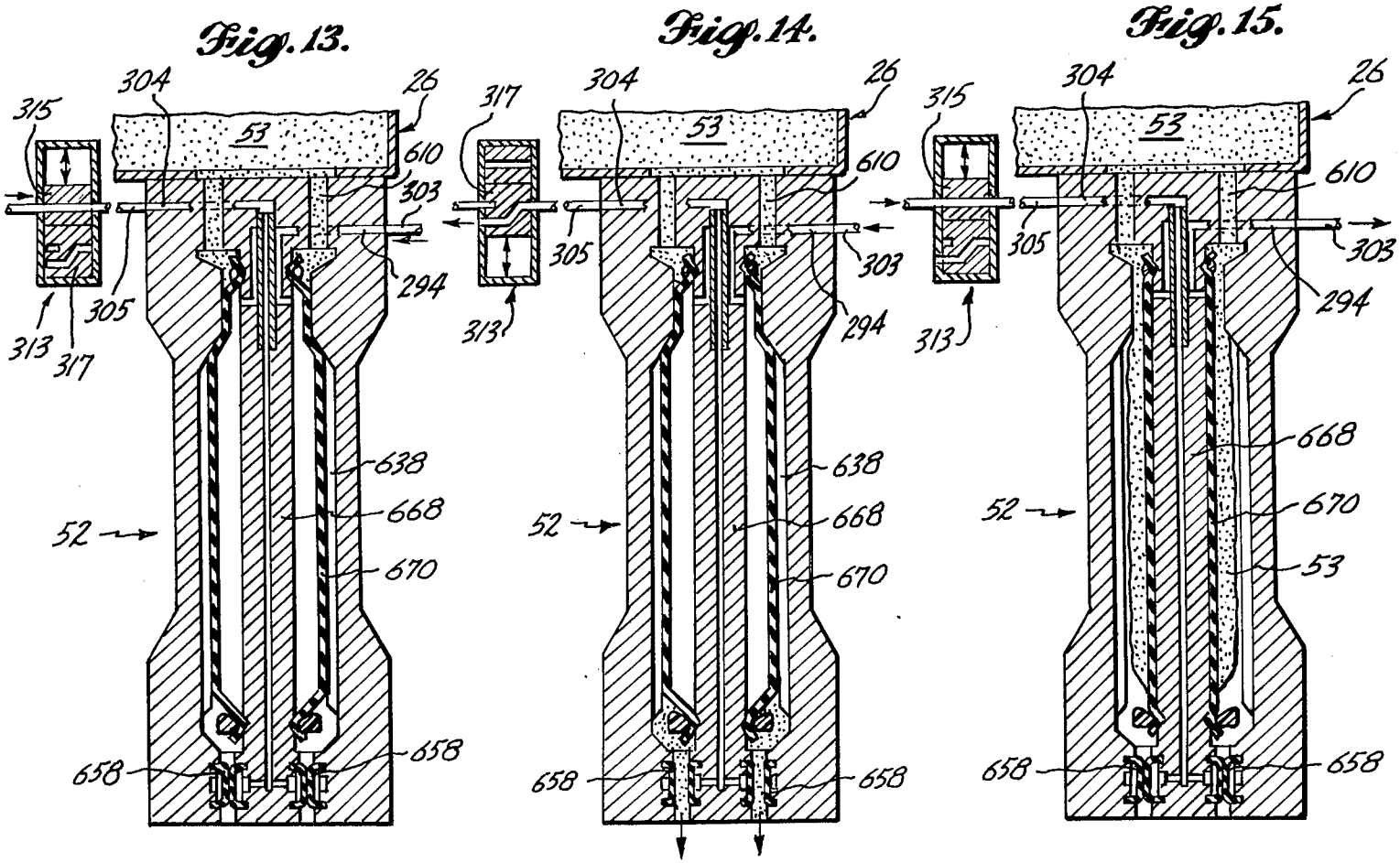
FIGS. 13–16 are sequential schematic diagrams illustrating the operation of the dispenser.

Beginning with a dispenser as depicted in FIG. 13, and assuming the dispenser is empty, pressurized air is directed via source conduit 303 into the first pneumatic conduit 294 from where the air is directed through the rod 668 to expand the tube 670 radially outwardly. As the tube 670 is expanded, its upper portion closes the passage from the inlet ports 610 into a chamber 638 as noted earlier. Additionally, the volume in the chamber 638 is reduced, thereby creating a plenum, pressurizing the chamber contents.

Concurrent with the expansion of the tube 670, valve 313 is set to its first position 315 and pressurized air is directed via conduit 305 from the source through valve 313 and into the connected second pneumatic conduit 304. From the second pneumatic conduit the air follows the above-described path through the rod 668 and valve spools and causes the inward expansion of the valve members 658 and consequent closure of the dispenser's outlet passage.

After both the tube 670 and valve members 658 are expanded, valve 313 is moved to its second position 317 (FIG. 14) to vent the air in the second pneumatic conduit 304, thereby allowing the valve members 658 to contract. The compressed air in the chamber 638 is thus forced out of the dispenser through the now-open outlet passage.

Next, with reference to FIG. 15, the valve members 658 are again expanded (valve 313 moved back to its first position 315) to close the outlet passage from the chamber 638 to the outlet ports. Then, air is vented from first pneumatic conduit 294 so that the tube 670 contracts, thereby rapidly increasing the volume of chamber 638. The rapid increase in the chamber volume creates a partial vacuum therein. As noted earlier, when the tube resiles, the inlet passage between the hopper 26 and the chamber 638 is opened. Thus, the vacuum in the chamber causes the filler material to be drawn into the chamber.

Figure 16:
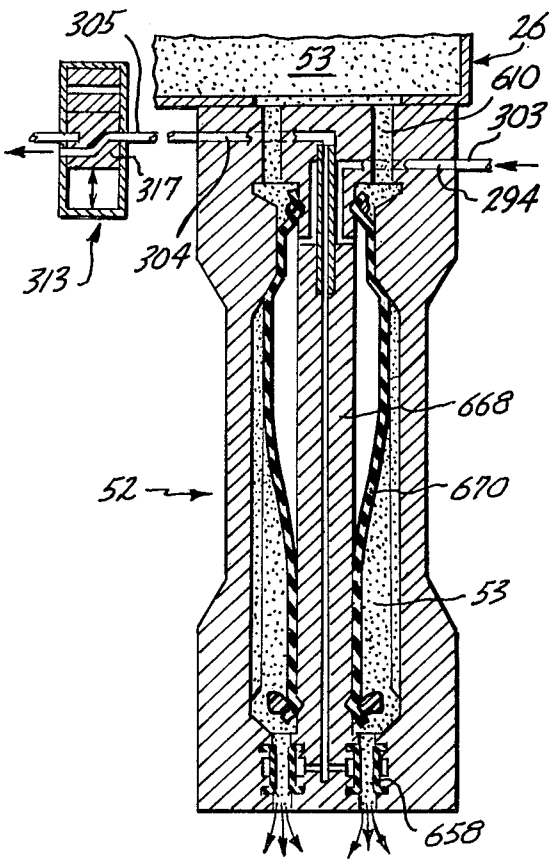

With the chamber so filled, the tube 670 is again expanded, pressurizing the chamber which now contains the filler material (FIG. 16). The dispenser is now "charged", i.e., ready to dispense discrete portions of the filler material. As noted, when the pressurized air that is applied to expand the valve members 658 is vented, the outlet opens as the valve members will contract. Thus, as shown in FIG. 16, as the valve members 658 contract, a portion of the filler material 53 that is contained in the pressurized chamber is forced outwardly through the outlet passage into a container positioned below. It can be appreciated that by controlling the frequency and duration of the expansion and contraction of the valve members 658 while the dispenser is charged, selectively-sized discrete portions of the filler material can be forcibly dispensed into the containers as needed to bring an underweight container to within the desired tolerance of the target weight.

When the filler material used is chopped or ground fish, bone fragments in the fish tend to wear and eventually puncture the expandable tube 670. To minimize this wear, the above-described grooves 639 (FIG. 12) formed in the chamber wall provide spaces into which these fragments can be pushed when the tube is expanded, thereby reducing the force between the tube and fragments and resulting wear.

It has also been found that when highly viscid material is used as the filler material it is more effectively moved through the dispenser when the chamber is sized so that its diameter gradually increases from top to bottom as illustrated in the figures.

Figure 17:
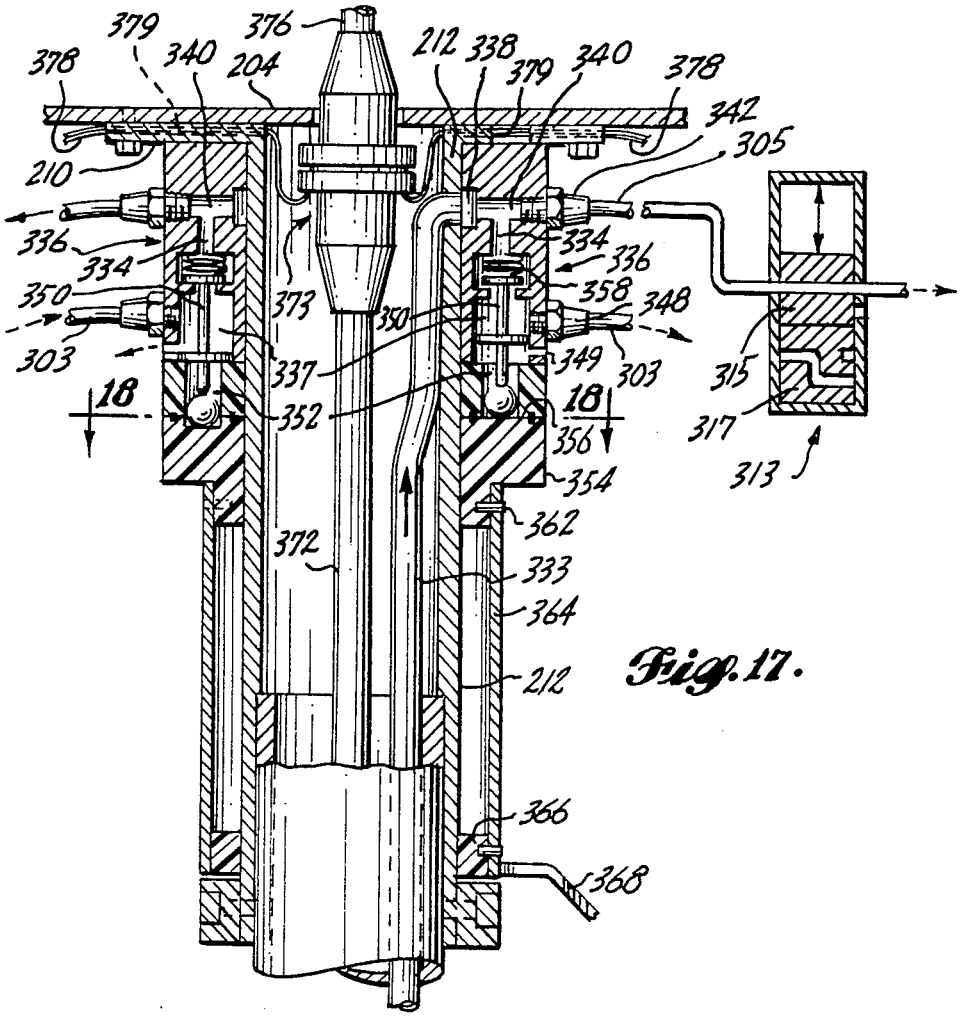
FIG. 17 is a sectional view of a portion of the pneumatic and electrical distribution system of the apparatus.
Figure 18:
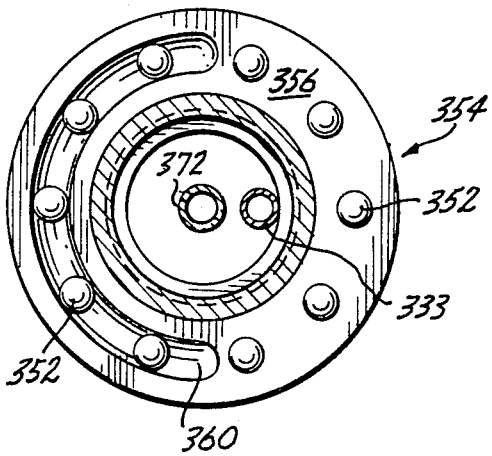
FIG. 18 is a sectional view taken along 18—18 of FIG. 17 showing the face of a cam used for pneumatic distribution control.

Turning now to the portion on the apparatus that is devoted to the distribution of air and electrical signals to the load cells 46 and dispensers 52, reference is made to FIGS. 7, 17 and 18. Pressurized air from a suitable source 326 is connected by a conduit 328 to a swivel fitting 330 that extends from the lower end of main shaft 50. A conduit 333, rotatably connected at one end to the swivel fitting 330, extend upwardly through the wall of support sleeve 212 which, as noted earlier, supports the hopper 26 on the main shaft 50 and rotates therewith. Completely surrounding the upper end of sleeve 212 and attached thereto is a manifold ring 336. The manifold ring carries an annular recess 338 around its internal circumference. The recess is horizontally aligned with the upper end of the conduit 333 so that air delivered by that conduit passes into the recess. The following portion of the discussion describes the pneumatic distribution system for one dispenser; however, it is understood that all dispensers are similarly arranged.

With reference to FIGS. 17 and 18, at ten points along the circumference of the manifold ring (corresponding to each of the ten dispensers), a short connector conduit 340 is formed in the manifold ring and interconnected between the recess 338 and the second source conduit 305. The second source conduit is connected to the connector conduit 340 at the outside wall of the manifold ring by a fitting 342. The two position valve 313 described earlier is preferably connected to the second source conduit 305 near the fitting 342 (see FIG. 7).

The connector conduit 340 has a branch 334 that leads to the upper end of a chamber 337 formed in the manifold ring. The first source conduit 303 is connected to the chamber 337 via fitting 348. A port 349 is formed in the manifold ring 336 to vent the chamber 337 to the atmosphere as will be described.

A poppet valve 350 is installed within the chamber 337. The valve is moved in response to a cam-actuated ball and plunger-type follower 352, and intermittently permits and interrupts airflow to the first source conduit 303. Specifically, it is pointed out that pressurized air needs to be supplied from the source to the first source conduit 303 only while the expandable tube 670 is expanded, that is, only while the air is supplied to the first pneumatic conduit 294. As described in detail hereinafter, the dispenser operation is such that during roughly one-half of the carousel's rotation cycle, the dispenser will have its expandable tube 670 expanded by the pressurized air directed through the first pneumatic conduit 294 so that the dispenser will be charged, ready to force filler material out of it as earlier described. During the remainder of the cycle, the first pneumatic conduit 294 will be vented, thereby allowing the tube 670 to contract, creating the vacuum that draws the filler material from the hopper 26 into the chamber 638 of the dispenser. Accordingly, with every one-half cycle of the carousel, the poppet valve 350 is moved through a first position, which opens flow of pressurized air from the chamber 337 to the first source conduit 303, and a second position, shutting flow to the first source conduit while venting the air therein to the atmosphere through the port 349 in chamber 337.

As noted, the poppet valve movement is controlled by a ball and plunger-type follower 352 that extends downwardly from the poppet valve and rides along the upper face 356 of an annular cam 354 that is nonrotatably supported around the support sleeve 212, immediately below the manifold ring 336. The ball and plunger-type follower 352 is biased downwardly by a coiled spring 358 that is disposed within chamber 337. The ball portion of follower 352 rolls along the face 356 of cam 354. A groove 360 with semicircular cross section is formed in the face of the annular cam 354. The groove 360 extends around one-half of the cam. As the ball and plunger follower 352 rides along the face of the cam, it moves between a low position, wherein it rides within the groove 360, and a high position, wherein it rolls along the flat portion of the cam face 356. When the follower 352 is in the high position (i.e., during one-half of the rotation of the carousel), the associated poppet valve 350 is moved to a first position within chamber 337. As shown in the right half of FIG. 17, the poppet valve 350 is configured so that when in the first position, pressurized air is allowed to flow through the chamber and out through the first source conduit 303 to expand the tube 670 in the dispenser. When the follower 352 is in the low position, the associated poppet valve 350 is moved to a second position within the chamber 337. As shown in the left side of FIG. 17, the poppet valve is configured so that when it is in the second position, the flow of air through the chamber 337 to the first source conduit 303 will be stopped and the chamber will be vented, thereby venting the air in the first source conduit so that the tube 670 will contract.

The lower end of the cam 354 is attached by threaded fastener 362 to a hollow, nonrotating support cylinder 364. The lower end of the support cylinder 364 is attached to a bearing 366 that is located between the rotating sleeve 212 and the inside wall of the support cylinder 364. With reference to FIGS. 1 and 7, the support cylinder 364 (hence the attached cam 354) is held nonrotatable with respect to the main shaft by a stop arm 368 that is fixed to and extends downwardly from the end of the support cylinder. The free end of the stop arm 368 abuts a protruding stop 370 that is fixed to a flat bar 369 that is immovably connected to the conveyor support beam by its attachment to the curved guide bar 112.

Attention is now directed to the manner in which the electrical conductors are connected to each load cell 46 and the dispenser pnuematic control valve 313. With reference to FIG. 7, the wires 51 connected to load cells 46 pass through an opening 198 in main shaft 50. The load cell control wires 51 merge into one end of an electrical conduit 372 that is fixed to the inside of main shaft 50 and rotates therewith. The other end of the conduit 372 is connected by a conventional slip ring connector 373 to a nonrotating electrical conduit 376 which is located within the core section 208 of the hopper 26. The nonrotating conduit 376, carrying electrical wires, continues through one of the tubes 224 that are formed in the hopper lid assembly 216, through the support column 218, and to the controller 48.

The electrical control wires 378 (FIG. 17) for operating each dispenser control valve 313 pass to that valve between the flange 210 of support sleeve 212 and the hopper bottom 204 through a groove 379 formed in the top surface of the flange. The control wires 378 are connected to the slip ring connector 373 at which they join the wires carried by the nonrotating conduit 376 to the controller 48.

Through the use of the electrical and pneumatic systems described above, a signal representative of the weight of each container as detected by the load cell is communicated to the controller. In response to signals from the controller, the pneumatically operated dispensers are activated as described above to dispense portions of the filler material into the container as they move with the carousel.

The apparatus 18 includes mechanisms for directing the containers off of the carousel 24 back to the conveyor belt 38 after the containers have been weighed and filled as necessary. Specifically, as shown in FIG. 3, an exit guide bar 382 is fastened at one end to the conveyor support beam 74 to project across the periphery of the carousel. The exit guide bar 382 has a concavely curved side that extends across the path of the containers on the carousel. Unless the containers are influenced by rejection levers are hereinafter described, the containers will strike the curved side of the exit guide bar 382 and slide along it onto the conveyor belt 38. A thin blade-like container stop 384 is fixed on the top disk 184 of the carousel alongside each platform 44. The container stops 384 are arranged so that when the container strikes the curved side of the exit guide bar 382, the stop 384 and guide bar create a scissor-like action against the container bottom to direct the container outwardly along the guide bar toward the conveyor belt 38.

Alternatively, the stops 384 can be omitted and a second transfer gear, configured and operated in a manner substantially identical to the earlier-described transfer gear 42, can be incorporated next to the exit guide bar for facilitating removal of the containers from the carousel.

If, upon entering the carousel 24, a container is already overfilled or is underweight by such a substantial amount that it is undesirable to fill it, the apparatus 18 includes mechanisms for diverting the container off of the platform 44 before it can re-enter the main conveyor system. Particularly, with reference to FIG. 3, two rejection levers 54 and 56 are mounted to a flat, thin support beam 380 that is fixed at one end of the exit guide bar 382. The support beam 380 is suspended over the carousel 24.

The rejection levers each comprise a flipper 386 that is pivotally mounted to one end of a flat base 388 that is mounted to the support beam 380. A pneumatically operated piston and cylinder assembly 390 is interconnected between the flipper and the base 388. When activated, the piston and cylinder assembly causes the flipper 386 to extend across the platform 44 that is carrying the rejected container and push the container off of the carousel and onto an adjacent rejection conveyor 58. The rejection levers 54 and 56 are operated by attached pneumatic valves 394, which are controlled by electrical signals initiated by the controller 48 when a rejectable container is detected.

While one rejection lever would be adequate, it is preferred that two be used; one for diverting underweight containers, the other for diverting overweight containers. In this regard, the rejection levers 54 and 56 are positioned to direct their associated containers onto two different areas (designated "under" and "over" in FIG. 3) of the adjacent rejection conveyor 58. The rejection conveyor is a conventional belt-type having an independent drive motor.

A photoelectric switch 398 is mounted to the discharge end 77 of the conveyor support beam 74 and is configured to receive a light beam 396 that is emitted from a conventional light source 399 that is mounted to one edge of the rejection conveyor 58. The path of the light beam 396 extends across the rejection conveyor 58 and the conveyor belt 38. Switch 398 provides a means of stopping the operation of the apparatus if containers become backed up on either the rejection conveyor 58 or the belt 38. Specifically, switch 398 is connected to the main drive of the apparatus and is configured so that if the light path 396 is interrupted by a container 30 that is stopped within the light path 396, the switch is activated to shut down the apparatus drive. The switch 398 includes a time delay to permit containers that are passing at normal operating speeds to interrupt the light path without activating the switch.

Figure 19:
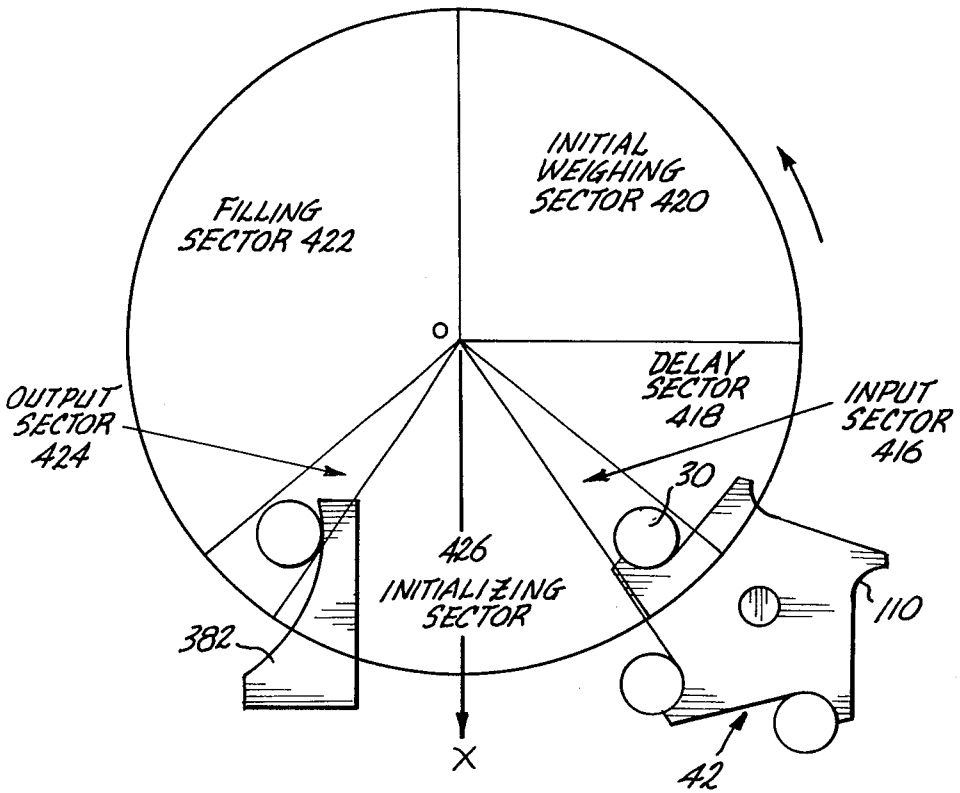
FIG. 19 is a diagram of the operational sequence of the apparatus during the time the containers are positioned on the carousel for weighing and filling.

Turning now to the operational sequence of the apparatus, with reference to FIGS. 1 and 19, the overall operation is controlled by a programmable controller 48 such as model PLC-2/30 manufactured by Allen Bradley Company of Highland Heights, Ohio. As shown in FIG. 1, a bus 401 containing suitable electronic conductors delivers the control signals between the controller 48 and the various elements of the apparatus (load cells, dispensers, rejection levers, etc.) through the electrical distribution system discussed above. A control panel 402 is mounted on the vertical support column 218 and has conventional control switches for starting and stopping the apparatus along with various indicators of the status of the apparatus (for example "power on," etc.).

A conventional encoder, such as Model No. 845A, manufactured by Allen Bradley Company of Highland Heights, Ohio, is used to provide data to the controller 48 regarding the position of the carousel with respect to a selected reference point. Specifically, as shown in FIG. 2, encoder 404 is mounted on a support beam **66*b* of base 20. The downwardly protruding shaft 406 of the encoder is rotated by a timing belt 408, which is wrapped around a timing belt pulley 410 on the shaft 406, and an adjacent timing belt pulley 412 fixed to the main shaft 50 of the apparatus. As shaft 50 is rotated, the encoder 404 produces a signal indicative of the rotational position of the shaft 50 relative to a selected reference point. That signal is continuously transmitted to the controller via suitable electrical conductors. The rotational position of the shaft 50 is readily correlated to the relative position of each platform 44** on the carousel. The position of each platform is therefore continuously monitored with respect to the operational cycle of the apparatus.

Turning now to the operational cycle of the apparatus, reference is made to FIG. 19, which is a diagram correlating the relative position of the container on the carousel 24 to the operations applied to it by the apparatus as the container rotates with the carousel.

Generally, a typical cycle of the carousel can be defined as beginning at an arbitrarily selected reference line O-X as appears in FIG. 19. From this reference line O-X, the carousel rotates counterclockwise. As shown in the figure, the complete 360° operational cycle of the carousel is divided into a plurality of individual operational sectors. An input sector 416 of the cycle is found between 34° and 50° from the reference line O-X. Through the input sector 416 of the cycle, a container 30 is moved onto the platform 44 by the transfer gear 42.

As the container continues its movement with the carousel, it next passes through a delay sector 418 of the cycle between 50° and 90° from the reference line O-X. Throughout this sector, the container "settles" on the platform as the vibrational energy imparted into the platform 44 by the container is dissipated before weight data is sampled by the load cell.

Between 90° and 180° from reference line O-X is an initial weighing sector 420 where the weight of the container is periodically detected by the load cell as earlier described. The data collected by the load cell 46 is continually transferred from the load cell to the controller 48 at a rate of approximately 120 times per second. Depending upon the initial weight of the container 30 as detected in the initial weighing sector 420, the container will be either accepted, rejected as substantially underweight or overweight, or it will be filled with discrete portions of filler material to bring the container to within the selected tolerance of the target weight.

Between 180° and 310° from the reference line O-X, the container passes through a filler sector 422. Through this sector underweight containers are brought up to the target weight with discrete portions of filler material dispensed from the overhead dispenser. In this regard, signals initiated by the controller 48 are transmitted to the control valve 313 of the dispenser in order to dispense the filler material as described earlier.

After the container is filled to within the desired tolerances of the target weight, it is directed off the carousel by the guard bar 382 at output sector 424, which is oriented 310° to 326° from reference line O-X.

During the container's movement through the filling sector 422, its weight is continuously monitored by the load cell. Hence, by the time the container exits the carousel, accurate information regarding the container's final weight will be recorded in the controller in digital electronic form, and available for any record-keeping purposes or for display with a suitable peripheral monitor.

Between the output sector 424 and input sector 416 is an initializing sector 426 wherein the load cell signal representing the weight of the platform in this sector is recorded in the controller as representing a container weight of zero, therefore accounting for any debris that may be stuck to the platform. In short, a zero weight datum for the containers is calculated in this sector.

Between the reference line O-X and the end of input weighing sector 416, the dispenser 52 is filled (or refilled if necessary) as described earlier.

It is clear that although the preferred relative sizes (i.e., duration) of the above-described sectors have been set forth with specificity, variations in the duration of the operational sectors can be accommodated with no adverse effects on the overall operation of the device.

Looking now at a particular example, a container for which the target weight is 250 grams enters the apparatus at input sector 416. Throughout the initial weighing sector 426, the container will be weighed as noted above and if its weight is within the desired tolerance of the target weight (for example 245 to 255 grams), then the controller will not effect any filling or rejection of the container and the container will simply exit the carousel at the exit guide bar 382, as described earlier.

If the weight of the container in this example is less than a previously programmed underweight limit (for example, 215 grams), then the container would not be filled, but would be rejected by underweight rejection lever 56 which is located at a position within the fill sector 422 and activated by a timely signal from the controller 48.

If the container enters the carousel and is substantially overweight, for example more than 255 grams, the container will be rejected by overweight rejection lever 54 which is positioned next to underweight rejection lever 56 and is activated to direct the container off the carousel as described earlier.

If the container is not so substantially underweight as to cause its rejection, the dispenser is activated to dispense discrete portions of filler material into the container in precise amounts as needed. In this regard, it is pointed out that the valve members of the dispenser can be opened for any selected time period to dispense the precise amount of filler material needed. It is clear that a relationship between the amount of time the valve is opened and the amount (weight) of filler material dispensed can be readily established by one of ordinary skill for any particular type of filler material and any size dispenser. Once the container is filled to within desired tolerances of the target weight, it will return as earlier described to the existing conveyance system for further processing as needed. It is pointed out that for any size container the controller can be programmed to operate the overall apparatus for any selected target weight, tolerance, overweight limit or underweight limit.

While the present invention has been described in relation to a preferred embodiment, it is to be understood that various alterations, substitutions of equivalents or other changes can be made without departing from the spirit and scope of the invention. For example, the apparatus formed in accordance with this invention can be utilized to fill empty containers with either semi-solid or liquid material. Furthermore, after completion of a canning operation, the hopper can be cleaned with suitably placed hoses carrying a cleaning solution. The solution can also be directed through the dispensers to remove any residual filler material.

The embodiments of the invention in which an exclusive property or privilege is claimed are defined as follows:

1. In a container filling apparatus wherein filler material is directed from a hopper into individual containers that are consecutively conveyed past the hopper, a dispenser connected to the hopper for dispensing the filler material in discrete portions, comprising:

(a) a housing having an inlet end and an outlet end, the housing also having a chamber formed therein, the housing also having an inlet passage and an outlet passage, the inlet passage extending through the inlet end and into the chamber, the inlet passage providing a passage between the hopper and the chamber, the outlet passage extending from the chamber and through the outlet end of the housing and providing a passage from the chamber out of the dispenser;

(b) an elongate, expandable pump member disposed within the housing, the pump member being positioned within the housing to extend from within the inlet passage and into the chamber to a point near the outlet passage, the expandable pump member, when expanded, closing the inlet passage and substantially compressing the contents of the chamber;

(c) an expandable valve member disposed within the outlet passage, the expandable valve member, when expanded, closing the outlet passage; and, (d) dispenser actuation means connected to the expandable pump member and the expandable valve member, the dispenser actuation means selectively expanding the expandable pump member and permitting the expandable pump member to contract to alternately create within the chamber a plenum and a partial vacuum for pressurizing the contents of the chamber and for drawing the filler material through the inlet passage into the chamber respectively, the dispenser actuation means further selectively expanding the expandable valve member and permitting the expandable valve member to contract for expelling discrete portions of the material through the outlet passage.

2. The apparatus of claim 1 wherein the surface of the housing that defines the chamber has a plurality of grooves formed therein extending along the length of the expandable pump member.

3. The dispenser of claim 1 wherein the dispenser actuation means includes:

(a) a source of pressurized air;

(b) first conduit means connected between the source of pressurized air and the expandable pump member for conducting pressurized air to the expandable pump member to expand the pump member;

(c) second conduit means connected between the source of pressurized air and the expandable valve member for conducting pressurized air to the expandable valve member to expand the valve member; and (d) first and second valve means connected to the first and second conduit means, respectively, the valve means being operable to permit and halt the flow of pressurized air through the first and second conduits and to vent the pressurized air that is conducted to the expandable pump and valve member, respectively, wherein the venting of pressurized air conducted to the pump member and valve member results in contraction of those members.

4. The dispenser of claim 3 further including an elongate support member having first and second ends, the support member being attached within the housing so that the expandable pump member fits over the support member, the expandable pump member being affixed at its opposing ends to the support member; and wherein the first conduit means is configured to conduct pressurized air through the support member to a location between the support member and the expandable pump member; and wherein the second conduit means is configured to conduct pressurized air through the support member to a point adjacent the expandable valve member.

5. The apparatus of claim 1, further comprising:

(a) a conveyor along which a plurality of containers can be advanced, the conveyor being supported by a conveyor support member;

(b) a rotatable member located adjacent to the conveyor support member, the rotatable member being for carrying a plurality of containers placed thereon;

(c) an elongate timing member having an entry end and an exit end and a helical flute extending between the entry end and the exit end, the timing member being rotatably mounted to the conveyor support member adjacent to the path of the containers to be advanced, the longitudinal axis of the timing member being substantially parallel to the path of the containers;

(d) a transfer gear for transferring containers form the conveyor to the rotatable member, the transfer gear being rotatably mounted near the exit end of the timing member between the timing member and the rotatable member, the transfer gear having a plurality of radial projections that project across the conveyor into the path of the containers;

(e) drive means for rotating the timing member and the transfer gear, the timing member and transfer gear cooperating so that the containers are received by the helical flute at the entry end of the timing member, the timing member controlling the rate of advancement of the containers along the conveyor as the timing member is rotated so that the projections of the transfer gear project between the advancing containers as it is rotated; and (f) a transfer guide element fixed between the conveyor and the rotatable member, the transfer guide element cooperating with the transfer gear so that the projections of the transfer gear direct the containers from the conveyor along the transfer guide element onto the rotatable member.

6. The apparatus of claim 5, further comprising adjustment means conneced to the timing member for selectively changing and fixing the position of the timing member about its rotational axis relative to the position of the transfer gear about its rotational axis.

7. The apparatus of claim 6, further comprising a first shaft affixed to one end of the timing member, the first shaft having the same rotational axis as the timing member; and wherein the drive means further includes a second shaft, and wherein the adjustment means includes a coupler assembly interconnected between the first and second shafts, the coupler assembly being adjustable to selectively fix the rotational position of the first and second shafts relative to each other.

8. The apparatus of claim 5, wherein the drive means drives the conveyor.

9. The apparatus of claim 5, further comprising a conveyance interrupt assembly located adjacent to the conveyor, the conveyance interrupt assembly including a gate having at least one substantially flat side, the gate having one end pivotally mounted to the conveyor support member, the gate also having biasing means attached thereto for urging the gate into a normal position wherein the gate is disposed with its flat side substantially parallel to the path of the containers, the conveyance interrupt assembly also including sensing means connected to the conveyor support member for sensing movement of the gate when the gate moves away from its normal position, the sensing means also being connected to the drive means and operable to terminate movement of the conveyor when the gate moves away from its normal position.

10. The system of claim 5, wherein the drive means for rotating the timing member and transfer gear includes at least one belt member interconnected between the timing member and the transfer gear, the belt member transferring the rotational movement of the transfer gear to the timing member to simultaneously rotate the timing member.

11. In a container filling apparatus wherein filler material is directed from a hopper into individual containers that are consecutively conveyed past the hopper, a dispenser connected to the hopper for dispensing the filler material in discrete portions, comprising:

(a) a housing having an inlet end and an outlet end, the housing also having a chamber formed therein, the housing also having an inlet passage and an outlet passage, the inlet passage extending through the inlet end and into the chamber, the inlet passage providing a passage between the hopper and the chamber, the outlet passage extending from the chamber and through the outlet end of the housing and providing a passage from the chamber out of the dispenser;

(b) an elongate, expandable pump member disposed within the housing, the pump member being positioned within the housing to extend from within the inlet passage and into the chamber to a point near the outlet passage, the expandable pump member, when expanded, closing the inlet passage and substantially compressing the contents of the chamber;

(c) an expandable valve member disposed within the outlet passage, the expandable valve member, when expanded, closing the outlet passage;

(d) dispenser actuation means connected to the expandable pump member and the expandable valve member, the dispenser actuation means selectively expanding the expandable pump member and permitting the expandable pump member to contract to alternately create within the chamber a plenum and a partial vacuum for pressurizing the contents of the chamber and for drawing the filler material through the inlet passage into the chamber respectively, the dispenser actuation means further selectively expanding the expandable valve member and permitting the expandable valve member to contract for expelling discrete portions of the material through the outlet passage, the dispenser actuation means including:

(i) a source of pressurized air;

(ii) first conduit means connected between the source of pressurized air and the expandable pump member for conducting pressurized air to the expandable pump member to expand the pump member;

(iii) second conduit means connected between the source of pressurized air and the expandable valve member for conducting pressurized air to the expandable valve member to expand the valve member; and, (iv) first and second valve means connected to the first and second conduit means, respectively, the valve means being operable to permit and halt the flow of pressurized air through the first and second conduits and to vent the pressurized air that is conducted to the expandable pump and valve member, respectively, wherein the venting of pressurized air conducted to the pump member and valve member results in contraction of those members;

(e) grooves on the surface of the housing that defines the chamber, the grooves extending along the length of the expandable pump member; and (f) an elongate support member having first and second ends, the support member being attached within the housing so that the expandable pump member fits over the support member, the expandable pump member being affixed at its opposing ends to the support member, and wherein the first conduit means conducts pressurized air through the support member to a location between the support member and the expandable pump member; and wherein the second conduit means conducts pressurized air through the support member to a point adjacent the expandable valve member.

12. In a container filling apparatus wherein filler material is directed from a hopper into individual containers that are consecutively conveyed past the hopper, a dispenser connected to the hopper for dispensing the filler material in discrete portions, comprising:

(a) a housing having an inlet and an outlet end, the housing also having a chamber formed therein, the housing also having an inlet passage and an outlet passage, the inlet passage extending through the inlet end and into the chamber, the inlet passage providing a passage between the hopper and the chamber, the outlet passage extending from the chamber and through the outlet end of the housing and providing a passage from the chamber out of the dispenser;

(b) an elongate, expandable pump member disposed within the housing, the pump member being positioned within the housing to extend from within the inlet passage and into the chamber to a point near the outlet passage, the expandable pump member, when expanded, closing the inlet passage and substantially compressing the contents of the chamber;

(c) an expandable valve member disposed within the outlet passage, the expandable valve member, when expanded, closing the outlet passage;

(d) dispenser actuation means connected to the expandable pump member and the expandable valve member, the dispenser actuation means selectively expanding the expandable pump member and permitting the expandable pump member to contract to alternately create within the chamber a plenum and a partial vacuum for pressurizing the contents of the chamber and for drawing the filler material through the inlet passage into the chamber respectively, the dispenser actuation means further selectively expanding the expandable valve member and permitting the expandable valve member to contract for expelling discrete portions of the material through the outlet passage; and (e) grooves on the surface of the housing that defines the chamber, the grooves extending along the length of the expandable pump member.

* * * * *

UNITED STATES PATENT AND TRADEMARK OFFICE

CERTIFICATE OF CORRECTION

PATENT NO. : 4,789,016

DATED : December 6, 1988

INVENTOR(S) : Stavros Mihail

It is certified that error appears in the above-identified patent and that said Letters Patent is hereby corrected as shown below:

| Column | Line | |
|---|---|---|
| 3 | 2 | "thorugh" should be --through-- |
| 4 | 64 | "transfered" should be --transferred-- |
| 7 | 30 | "24" should be --42-- |
| 9 | 23, 24 | "rotation" should be --rotational-- |
| 9 | 58 | "normaly" should be --normally-- |
| 10 | 43 | "manner" should be --member-- |
| 11 | 68 | "thorugh" should be --through-- |
| 12 | 21 | "think" should be --thin-- |
| 14 | 14 | "price" should be --piece-- |
| 16 | 26 | "600" should be --660-- |
| 19 | 41 | "extend" should be --extends-- |
| 19 | 41 | After the word "the", insert --main shaft and is fastened at its upper end to an aperture formed through the-- |
| 28 | 38 | After the word "inlet", insert the word --end-- |

Signed and Sealed this

Twenty-eighth Day of November 1989

*Attest:*

JEFFREY M. SAMUELS

*Attesting Officer* *Acting Commissioner of Patents and Trademarks*